US009248988B2

(12) United States Patent
Keily et al.

(10) Patent No.: US 9,248,988 B2
(45) Date of Patent: Feb. 2, 2016

(54) MULTI-FUNCTION DISPENSER FOR DISPENSING PAPER SHEET MATERIAL

(71) Applicant: DISPENSING DYNAMICS INTERNATIONAL, City of Industry, CA (US)

(72) Inventors: Joel P. Keily, Corona, CA (US); Niko Anthony Cvjetkovic, Los Alamitos, CA (US)

(73) Assignee: Dispensing Dynamics International, City of Industry, CA (US)

( * ) Notice: Subject to any disclaimer, the term of this patent is extended or adjusted under 35 U.S.C. 154(b) by 528 days.

(21) Appl. No.: 13/744,650

(22) Filed: Jan. 18, 2013

(65) Prior Publication Data

US 2014/0091168 A1 Apr. 3, 2014

Related U.S. Application Data

(63) Continuation-in-part of application No. 12/455,121, filed on May 27, 2009, now Pat. No. 8,382,026.

(51) Int. Cl.

| | |
|---|---|
| ***B65H 63/08*** | (2006.01) |
| ***B65H 16/00*** | (2006.01) |
| ***B65H 20/00*** | (2006.01) |
| ***A47K 10/34*** | (2006.01) |
| ***A47K 10/36*** | (2006.01) |

(52) U.S. Cl.

CPC ..... *B65H 16/005* (2013.01); *A47K 10/34* (2013.01); *A47K 10/3625* (2013.01); *A47K 10/3643* (2013.01); *B65H 20/005* (2013.01); *A47K 2010/365* (2013.01); *A47K 2010/3668* (2013.01); *B65H 2301/4493* (2013.01); *B65H 2301/44342* (2013.01); *B65H 2403/42* (2013.01); *B65H 2403/512* (2013.01); *B65H 2557/512* (2013.01); *B65H 2701/1924* (2013.01)

(58) Field of Classification Search

CPC ..... A47K 10/24; A47K 10/26; A47K 10/32; A47K 10/34; A47K 10/36; A47K 10/38; B65H 16/00; B65H 16/10; B65H 61/00

USPC ..... 242/563, 563.2, 564, 564.1, 564.2

See application file for complete search history.

(56) References Cited

U.S. PATENT DOCUMENTS

| | | | |
|---|---|---|---|
| 3,715,085 | A | 2/1973 | Kobayashi et al. |
| 3,730,403 | A | 5/1973 | Ratti |
| 3,730,409 | A | 5/1973 | Ratti |
| 3,737,087 | A | 6/1973 | Rooklyn |
| 3,949,918 | A | 4/1976 | Golner et al. |
| 3,998,308 | A | 12/1976 | Yeakley |
| 4,122,738 | A | 10/1978 | Granger |
| 4,170,390 | A | 10/1979 | McCabe |
| 4,270,818 | A | 6/1981 | McCabe |
| 4,573,750 | A | 3/1986 | Golby |
| 4,666,099 | A | 5/1987 | Hoffman et al. |
| 4,676,131 | A | 6/1987 | Cassia |

(Continued)

FOREIGN PATENT DOCUMENTS

| | | |
|---|---|---|
| WO | 9959457 | 11/1999 |
| WO | 0063100 | 10/2000 |

*Primary Examiner* — William A Rivera

(74) *Attorney, Agent, or Firm* — Thomas R. Lampe

(57) ABSTRACT

A paper sheet material dispenser selectively operable to dispense paper toweling or other paper sheet material from a roll of paper sheet material employing a plurality of alternative operational modes.

25 Claims, 15 Drawing Sheets

(56) References Cited

U.S. PATENT DOCUMENTS

| | | | | |
|---|---|---|---|---|
| 4,717,043 | A | 1/1988 | Groover et al. | |
| 4,721,265 | A | 1/1988 | Hawkins | |
| 4,738,176 | A | 4/1988 | Cassia | |
| 4,790,490 | A | 12/1988 | Chakravorty | |
| 4,796,825 | A | 1/1989 | Hawkins | |
| 4,826,262 | A | 5/1989 | Hartman et al. | |
| 4,848,854 | A | 7/1989 | Kennedy | |
| 4,960,248 | A | 10/1990 | Bauer et al. | |
| 5,131,302 | A | 7/1992 | Watanabe | |
| 5,244,263 | A | 9/1993 | Kennedy | |
| 5,335,811 | A | 8/1994 | Morand | |
| 5,340,045 | A | 8/1994 | Arabian et al. | |
| 5,375,920 | A | 12/1994 | Cassia | |
| 5,417,783 | A | 5/1995 | Boreali et al. | |
| 5,441,189 | A | 8/1995 | Formon et al. | |
| 5,452,832 | A | 9/1995 | Niada | |
| 5,630,526 | A | 5/1997 | Moody | |
| 5,657,945 | A | 8/1997 | Bryant | |
| 5,691,919 | A | 11/1997 | Gemmell et al. | |
| 5,772,291 | A | 6/1998 | Byrd et al. | |
| 5,816,514 | A | 10/1998 | Duclos et al. | |
| 5,878,381 | A | 3/1999 | Gemmell et al. | |
| 6,012,664 | A | 1/2000 | Duclos et al. | |
| 6,079,305 | A | 6/2000 | Bloch et al. | |
| 6,105,898 | A | 8/2000 | Byrd et al. | |
| 6,112,631 | A | 9/2000 | VanAlstine | |
| 6,314,850 | B1 | 11/2001 | Morand | |
| 6,363,824 | B1 | 4/2002 | Granger | |
| 6,412,655 | B1 | 7/2002 | Stuetzel et al. | |
| 6,412,679 | B2 | 7/2002 | Formon et al. | |
| 6,419,136 | B2 | 7/2002 | Formon et al. | |
| 6,446,901 | B1 | 9/2002 | Haen et al. | |
| 6,553,879 | B2 | 4/2003 | Morand | |
| 6,820,785 | B2 | 11/2004 | Kapiloff | |
| 6,892,620 | B2 | 5/2005 | Kapiloff | |
| 7,044,421 | B1 | 5/2006 | Omdoll et al. | |
| 7,168,602 | B2 * | 1/2007 | Broehl | 225/106 |
| 7,354,015 | B2 | 4/2008 | Byrd et al. | |
| 7,398,944 | B2 | 7/2008 | Lewis et al. | |
| 7,793,882 | B2 * | 9/2010 | Reinsel | A47K 10/36 242/563 |
| 7,987,756 | B2 | 8/2011 | Lewis et al. | |
| 8,082,827 | B2 | 12/2011 | Friesen et al. | |
| 2003/0110911 | A1 * | 6/2003 | Kapiloff | 83/208 |
| 2010/0301157 | A1 * | 12/2010 | Keily et al. | 242/564.1 |
| 2012/0167739 | A1 * | 7/2012 | Lewis et al. | 83/663 |

* cited by examiner

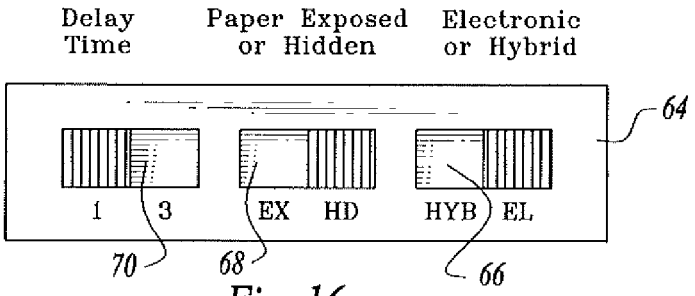
Fig. 16
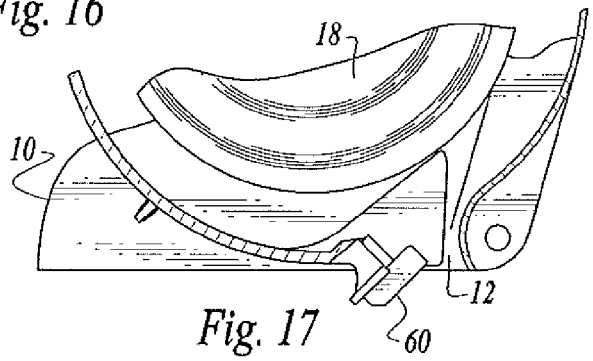
Fig. 17
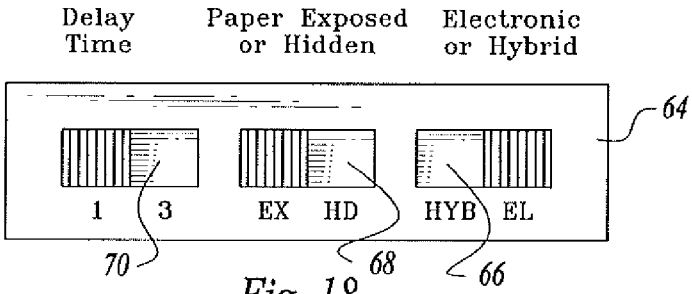
Fig. 18
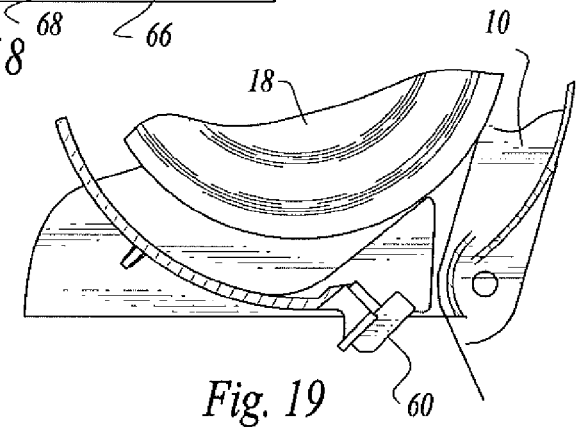
Fig. 19
Fig. 20
| | |
|---|---|
| Fig. 20A | Fig. 20B |
| Fig. 20C | Fig. 20D |

*Fig. of 40*

MULTI-FUNCTION DISPENSER FOR DISPENSING PAPER SHEET MATERIAL

This application is a continuation-in-part of U.S. patent application Ser. No. 12/455,121, filed May 27, 2009.

TECHNICAL FIELD

This invention relates to apparatus selectively operable to dispense paper toweling or other paper sheet material from a roll employing a plurality of alternative operational modes.

BACKGROUND OF THE INVENTION

Many dispenser systems are known in the prior art for dispensing paper toweling from rolls thereof. In some cases, the paper toweling is comprised of individual paper towel segments separated by perforated tear lines, and in others the toweling has no perforated tear lines formed therein, severing or cutting individual sheets from the toweling accomplished by some suitable severing structure incorporated in the dispenser.

Many towel dispensers of a purely mechanical nature have been developed and utilized over the years for dispensing paper towels, including dispensers which are actuated by a user grasping and pulling on a tail of the toweling extending from the dispenser housing.

For example, U.S. Pat. Nos. 6,314,850 and 6,553,879 disclose apparatus for dispensing paper toweling including a rotatable toweling support roller and a cutter blade pivotally mounted on the outer peripheral portion of the roller. The blade is movable between a first position in which the cutting edge of the blade is positioned closely adjacent to the outer peripheral portion and a second position in which the blade is disposed at an angle relative to the outer peripheral portion with the cutting edge of the blade spaced from the toweling support roller. The cutter blade when in the second position projects in a direction generally opposed to the direction of rotation of the toweling support roller. Pulling force exerted on the toweling by a user not only serves to rotate the toweling support roller but also causes the toweling to bear against the cutting edge of the cutter blade to sever the toweling.

The apparatus of U.S. Pat. Nos. 6,314,850 and 6,553,879 has met with considerable commercial success; however, some problems with "tabbing" have occurred during use of the dispenser. Tabbing occurs when a piece of towel tears from the sheet when a user grasps and pulls the paper. Tabbing may occur with one or two hand pulls. Papers that absorb water at the greatest rate are most likely to tab, the rate of water absorbency varying by paper manufacturer and grade. Tabbing also becomes a particular problem when low basis weight paper is to be dispensed. It is not an exaggeration to say that virtually all paper towel dispensers of a purely mechanical nature which rely on direct pulling of the toweling by a user to transport the toweling and actuate moveable cutter or severing blades have a tabbing problem to some extent.

Electro-mechanical dispensers employing an electric motor to transport toweling and actuate cutter mechanisms are also well known. Such arrangements include both dispensers which are manually actuated, as by means of a push button and those employing a sensor, such as a sensor sensing proximity of a user's hand, to initiate operation.

U.S. Pat. No. 6,820,785, issued Nov. 23, 2004, discloses an electro-mechanical roll towel dispenser including a housing with a roll carrier disposed therein to rotatably support a roll of towel material. An electro-mechanical feed mechanism is disposed in the housing to dispense measured sheets of the towel material. The feed mechanism operates in a first mechanical operational mode wherein the towel sheets are dispensed by a user grasping and pulling on a tail of the towel material extending from the housing, and a second electrical operational mode wherein a measured length of a next sheet is automatically fed from the housing to define the tail for the next user.

The dispenser of U.S. Pat. No. 6,820,785 includes a sensor for detecting a parameter that is changed by an initial pull exerted on a tail of a web of material extending from the opening of the dispenser. The sensor also generates a signal sent from the sensor to a control circuit or circuitry causing the motor employed in the apparatus to drive the feed mechanism until a measured length of web material that includes the tail of web material has been fed from the dispenser in the form of a measured sheet for subsequent removal by the user.

Similar devices are disclosed in U.S. Pat. No. 3,730,409 and Patent Publication Document WO 00/63100. The devices of these latter two documents have sensors for detecting movement of a tail end of web material such that the feed mechanism is activated in response to detecting the movement.

Co-pending U.S. patent application Ser. No. 13/466,334, filed May 8, 2012 which is a continuation-in-part application based on now abandoned U.S. patent application Ser. No. 12/290,220, filed Oct. 28, 2008, discloses paper toweling dispenser apparatus incorporating a motor which reduces pull force which must be exerted by a user of the apparatus during dispensing. Initial transport of the toweling is accomplished by the user exerting a pull force of very low magnitude. On the other hand, when cutting of toweling is occurring, which normally requires application of a relatively high pull force, during which tabbing is most likely, an electric motor employed in the apparatus provides assistance, reducing the pull force that would otherwise have to be applied by a consumer.

In addition, the apparatus of co-pending U.S. patent application Ser. No. 13/466,334 incorporates dual mode functioning; that is, when the batteries normally utilized to energize the motor deplete, toweling can still be cut and accessed by a user rotating a feed knob to advance the tail. The user can remove the sheet by pulling on the tail as usual. A key to maintaining low pull force in this mode is to disengage the gear motor from the toweling support roller through the use of a one-way clutch bearing or other clutch system such as pawls.

The user can manually turn the feed knob or handle until the sheet is cut and advanced. If the toweling is completely cut by the cutting mechanism, the severed sheet can be fully advanced and can be removed by the user without pulling required or, of the toweling is partly severed, the user can rotate the knob to advance a tail and then pull on the tail. In addition, the knob may be utilized to rotate the toweling support roller and toweling thereon until the motor is energized, rather than the user directly manually applying pulling forces on the tail to accomplish this.

U.S. Pat. No. 8,082,827, issued Dec. 27, 2011, discloses a towel dispenser which incorporates a one-way rotational coupling enabling the dispenser to be operated by motor or in a manual dispensing mode separately from the motor.

U.S. Pat. No. 7,987,756, issued Aug. 2, 2011, discloses a dispenser for paper toweling which incorporates a cutter blade within an actuator roller carrying paper toweling. A drive motor is activated to drive the actuator roller during the time the cutter blade is being extended to cut the paper toweling and deactivated when the cutter blade is retracted.

The following documents are also believed to be representative of the current state of the prior art in this field: U.S. Pat. No. 3,715,085, issued Feb. 6, 1973, U.S. Pat. No. 3,730,409, issued May 1, 1973, U.S. Pat. No. 3,737,087, issued Jun. 5, 1973, U.S. Pat. No. 3,949,918, issued Apr. 13, 1976, U.S. Pat. No. 3,998,308, issued Dec. 21, 1976, U.S. Pat. No. 4,666,099, issued May 19, 1987, U.S. Pat. No. 4,676,131, issued Jun. 30, 1987, U.S. Pat. No. 4,721,265, issued Jan. 26, 1988, U.S. Pat. No. 4,738,176, issued Apr. 19, 1988, U.S. Pat. No. 4,790,490, issued Dec. 13, 1988, U.S. Pat. No. 4,796,825, issued January, 1989, U.S. Pat. No. 4,960,248, issued Oct. 2, 1990, U.S. Pat. No. 5,131,302, issued Jul. 21, 1992, U.S. Pat. No. 5,452,832, issued Sep. 26, 1995, U.S. Pat. No. 5,772,291, issued Jun. 30, 1998, U.S. Pat. No. 6,079,305, issued Jun. 27, 2000, U.S. Pat. No. 6,105,898, issued Aug. 22, 2000, U.S. Pat. No. 6,412,655, issued Jul. 2, 2002, U.S. Pat. No. 6,412,679, issued Jul. 2, 2002, Patent Document No. WO 9959457, dated November, 1999, Patent Document No. WO 0063100, dated October, 2000, U.S. Pat. No. 7,398,944, issued Jul. 15, 2008, U.S. Pat. No. 6,892,620, issued May 17, 2005, U.S. Pat. No. 7,044,421, issued May 16, 2006, U.S. Pat. No. 4,573,750, issued Mar. 4, 1986, U.S. Pat. No. 4,826,262, issued May 2, 1989, U.S. Pat. No. 6,446,901, issued Sep. 10, 2002, U.S. Pat. No. 4,270,818, issued Jun. 2, 1981, U.S. Pat. No. 6,112,631, issued Sep. 5, 2000, U.S. Pat. No. 5,375,920, issued Dec. 27, 1994, U.S. Pat. No. 7,354,015, issued Apr. 8, 2008, U.S. Pat. No. 4,738,176, issued Apr. 19, 1988, U.S. Pat. No. 4,790,490, issued Dec. 13, 1988, U.S. Pat. No. 6,079,305, issued Jun. 27, 2000, U.S. Pat. No. 6,419,136, issued Jul. 16, 2002, U.S. Pat. No. 6,412,679, issued Jul. 2, 2002, U.S. Pat. No. 5,441,189, issued Aug. 15, 1995, U.S. Pat. No. 5,878,381, issued Mar. 2, 1999, U.S. Pat. No. 5,691,919, issued Nov. 25, 1997, U.S. Pat. No. 5,452,832, issued Sep. 26, 1995, U.S. Pat. No. 5,340,045, issued Aug. 23, 1994, U.S. Pat. No. 5,335,811, issued Aug. 9, 1994, U.S. Pat. No. 5,244,263, issued Sep. 14, 1993, U.S. Pat. No. 4,848,854, issued Jul. 18, 1989, U.S. Pat. No. 4,738,176, issued Apr. 19, 1988, U.S. Pat. No. 4,270,818, issued Jun. 2, 1981, U.S. Pat. No. 4,170,390, issued Oct. 9, 1979, U.S. Pat. No. 5,657,945, issued Aug. 19, 1997, U.S. Pat. No. 4,122,738, issued Oct. 31, 1978, U.S. Pat. No. 6,012,664, issued Jan. 11, 2000, U.S. Pat. No. 5,816,514, issued Oct. 6, 1998, U.S. Pat. No. 5,417,783, issued May 23, 1995, U.S. Pat. No. 4,717,043, issued Jan. 5, 1988, U.S. Pat. No. 5,630,526, issued May 20, 1997, U.S. Pat. No. 6,363,824, issued Apr. 2, 2002, U.S. Pat. No. 6,293,486, issued Sep. 25, 2001, U.S. Pat. No. 6,695,246, issued Feb. 24, 2004, U.S. Pat. No. 6,854,684, issued Feb. 15, 2005, U.S. Pat. No. 6,988,689, issued Jan. 24, 2006, U.S. Pat. No. 7,325,767, issued Feb. 5, 2008, U.S. Pat. No. 7,325,768, issued Feb. 5, 2008, U.S. Pat. No. 7,168,602, issued Jan. 30, 2007, U.S. Pat. No. 6,592,067, issued Jul. 15, 2003, U.S. Pat. No. 7,341,170, issued Mar. 11, 2008, U.S. Pat. No. 7,182,288, issued Feb. 27, 2007, U.S. Pat. No. 7,296,765, issued Nov. 20, 2007, U.S. Pat. No. 6,977,588 issued Dec. 20, 2005 and U.S. Pat. No. 6,820,785, issued Nov. 23, 2004.

DISCLOSURE OF INVENTION

The present invention relates to a multi-function paper sheet dispenser selectively operable to dispense paper sheet material from a roll of paper sheet material, such as paper toweling, employing a plurality of alternative operational modes. The invention disclosed herein is employed to dispense paper toweling. The desired mode of operation can be selected utilizing control switches associated with sensor structure and electronic control circuitry of the dispenser. The multi-function paper towel dispenser is characterized not only by its versatility, but by its relative simplicity, ease of use and reliability in any of the operational modes selected. Two of the modes are a paper hidden mode and a paper exposed mode, each of which utilizes sensor structure in combination with electronic control circuitry to operate an electric motor driven rotatable toweling support roller to partially cut and dispense the paper toweling.

The electric motor is also utilized to rotate the paper toweling support roller when not employing the sensor structure, the motor essentially operating in a hybrid mode wherein an electric switch operatively associated with the electric motor and with the toweling support roller is responsive to rotation of the toweling support roller caused by a user of the paper towel dispenser apparatus pulling on the paper toweling projecting through an opening in the dispenser housing and extending outwardly from the housing to a first position to energize the electric motor when the toweling support roller reaches the first position and cause rotation of the rotatable toweling support roller by the electric motor from the first position to a second position.

A cutter blade is provided for substantially or completely severing the paper on the toweling support roller during rotation thereof caused solely by the user pulling on the paper toweling tail and without energization and use of the electric motor before the toweling support roller reaches the first position.

The electric switch is responsive to rotation of said toweling support roller by the energized electric motor to the second position to de-energize the electric motor and present a new tail projecting through the opening and extending outwardly from the housing.

The sensor structure of the multi-function paper towel dispenser is operatively associated with the electric motor to energize the electric motor and cause rotation of the toweling support roller to transport the paper toweling for dispensing from the dispenser in either a first mode of operation wherein the electric motor is energized responsive to the sensor structure sensing positioning of a user's hand at a predetermined location external of the housing or in a second mode of operation wherein the electric motor is energized responsive to the sensor structure sensing the removal of a toweling tail from a location external of the housing.

The electronic control circuitry for operating the dispenser in either the first mode of operation or in the second mode of operation utilizes simple, reliable mechanical switches as compared to electronic switches that are controlled by logic controller/programmable chips, the case in the prior art wherein programmable logic electronics are employed. Programmable logic is required because fixed parameters are not employed. Because the present invention has fixed parameters and utilizes discrete digital logic instead of programmable logic, no controller chip is required, simple resistors and capacitors being utilized along with the use of mechanical electric switches versus electronic switches. As will be seen below, the invention incorporates a number of other unique features, including energy saving features.

Other features, advantages and objects of the present invention will become apparent with reference to the following description and accompanying drawings.

BRIEF DESCRIPTION OF DRAWINGS

FIG. 16 is a view similar to FIGS. 6 and 11, but illustrating different control switch positions;

FIG. 17 shows the condition of a toweling tail when hidden as selected by the middle control switch in FIG. 16;

FIG. 18 illustrates the middle switch moved to a position that results in the tail being exposed;

FIG. 19 shows the toweling tail exposed and extending from the bottom of the dispenser housing;

FIG. 20 depicts relative positioning of four segments of the electronic control circuitry of the invention as shown in FIGS. 20A, 20B, 20C and 20D;

FIG. 40 is a flow chart illustrating operation of a second alternative embodiment of the invention.

MODES FOR CARRYING OUT THE INVENTION

Figure 1:
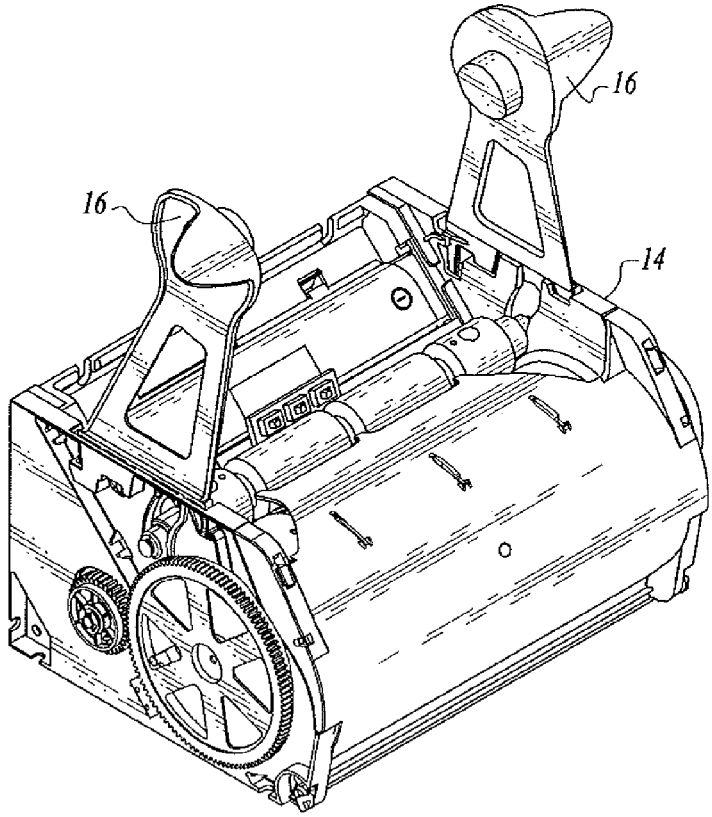
FIG. 1 is a front, perspective view illustrating internal components of a multi-function paper toweling dispenser constructed in accordance with the teachings of the present invention.

Referring now to the drawings, a multi-function paper towel dispenser constructed in accordance with the teachings of the present invention is illustrated. As explained and disclosed in greater detail below, the dispenser is selectively operable to dispense paper toweling from a roll of paper toweling employing a plurality of alternative operational modes.

The paper towel dispenser includes a housing 10 (shown in FIGS. 3, 9-10, 13, 14, 17, 19 and 22-26), the housing having a towel dispensing opening 12 at the bottom thereof.

Mounted in the interior of the housing 10 is an assembly 14 (see FIGS. 1-3) including operational structural components of the multi-function paper towel dispenser. These structural elements include a roll support in the form of spaced support arms 16 insertable into the open ends of a supply roll of paper toweling in a conventional fashion.

A rotatable toweling support roller 18 has a cylindrically-shaped outer peripheral surface and is rotatable in a predetermined direction of rotation. A cutter blade 20 pivotally mounted on roller 18 (see FIGS. 10 and 24) has attached to the ends thereof cam followers 22, each including a cam follower arm and roller. Each roller rides in a channel 25 of a cam 24. Cams 24 are located at both ends of the assembly 14, it being understood that the channels of these cams are directed inwardly.

The blade, cam follower and cam system employed are suitably that disclosed in above-referenced co-pending U.S. patent application Ser. No. 13/466,334, as well as in U.S. Pat. Nos. 6,314,850 and 6,553,879, the teachings of which are incorporated by reference into this application.

Rotation of toweling support roller 18 will cause the cam followers to move along the cam surfaces defining the channels. This, in turn, will cause the cutter blade 20 to pivot relative to the toweling support roller 18.

The cutter blade is movable between an inactive position wherein the cutter will not sever the toweling and a severing position wherein the cutter blade is positioned outwardly of the toweling support roller to at least partially sever the toweling on the toweling support roller.

An electric motor 30 is operatively associated with the toweling support roller for selectively rotating the toweling support roller. A mechanical electric switch 32 is operatively associated with the electric motor and with the toweling support roller. The electric switch is electrically connected to the electric motor, with no control circuit boards intermediate the electric motor and the electric switch.

The electric switch 32 is responsive to rotation of the toweling support roller 18 by a user of the dispenser from a rest or inactive position to a first position to energize the electric motor when the toweling support roller reaches the first position and cause rotation of the toweling support roller by the electric motor from the first position to a second position and reducing the pull force required by a user pulling the paper toweling during rotation of the toweling support roller between the first position and the second position. Further, the mechanical electrical switch 32 is responsive to rotation of the toweling support roller beyond the second position to deenergize the electric motor. This mode of operation, sometimes hereinafter referred to as a hybrid or third mode of operation, is described in more detail below.

Mechanical electric switch 32 includes a switch actuator element 34 having a roller 36 at the end thereof which is biased into engagement with a circular end 38 of the toweling support roller 18. The switch actuator element 32 alternatively opens or closes the switch during rotation of the toweling support roller.

Located at circular end 38 of the toweling support roller and engaged by the switch actuator element roller during rotation of the toweling support roller is an arcuate projection 40. The projection extends only part way along the periphery of the toweling support roller and has two tapered projection ends 42. Extending completely about circular end 38 and disposed inwardly of the arcuate projection is a toweling support roller gear 44 having teeth. Meshing with the teeth of the toweling support roller gear are teeth of a drive gear 46 which is driven by electric motor 30, the latter suitably being in the form of a DC gear motor. A one-way clutch needle bearing 48 connects the drive gear to the electric motor to allow the performance of certain functions indicated below. Electric wiring connects the switch 32 to the electric motor. The mechanical electric switch 32 is located between the electric motor and a source of DC power in the form of electric batteries (not shown).

Figure 6:
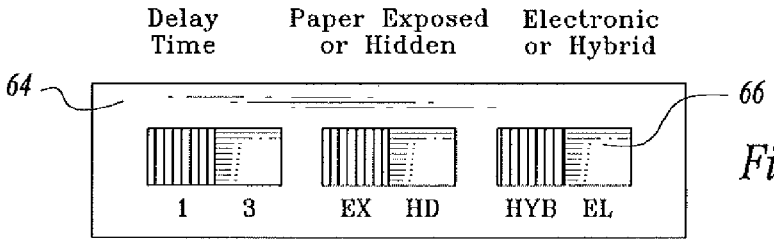
FIG. 6 is a plan view illustrating a switch panel having mode selection control switches and a time delay control switch.
Figure 7:
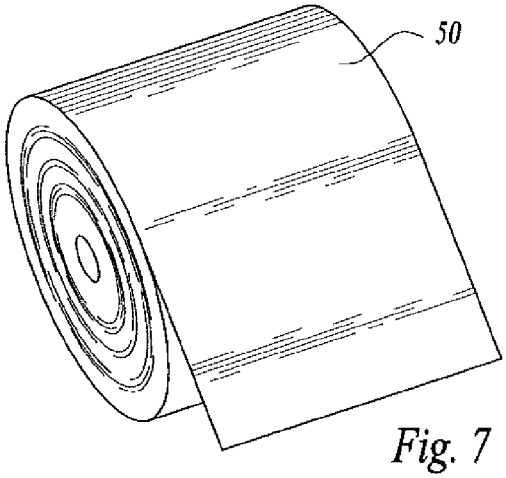
FIG. 7 is a perspective view of an unperforated supply roll of toweling that may be utilized in the multi-function paper towel dispenser.

FIGS. 6-10 and FIGS. 27-40 may now be referred to in connection with operation of the multi-function paper towel dispenser in the third or hybrid mode. In such mode the roll of uncut or unperforated toweling 50 as shown in FIG. 7 would be used as the supply roll. FIG. 6 shows the setting of a control switch 66 to the hybrid setting, the hybrid mode of operation being but one of the mode of operation options, as will be explained in greater detail below.

Figure 8:
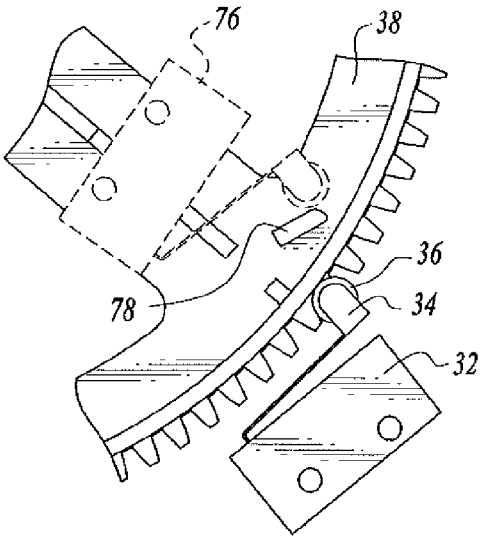
FIG. 8 is a greatly enlarged, side view illustrating a portion of the drive gear of the toweling support roller and its relationship with mechanical electric switches, one of which is shown in solid lines and the other in dash lines.
Figure 9:
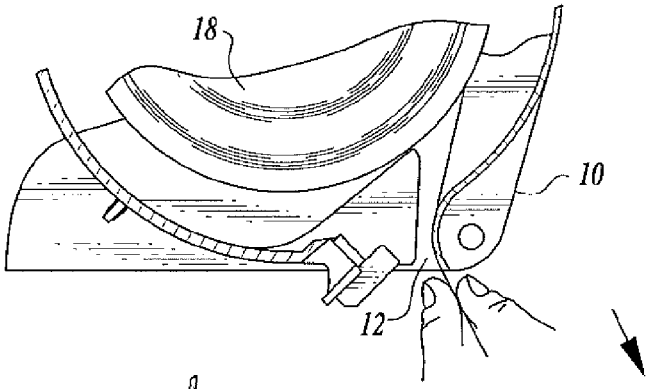
FIG. 9 shows a towel tail being grasped and dispensed when the control switches are in the positions shown in FIG. 6.
Figure 27:
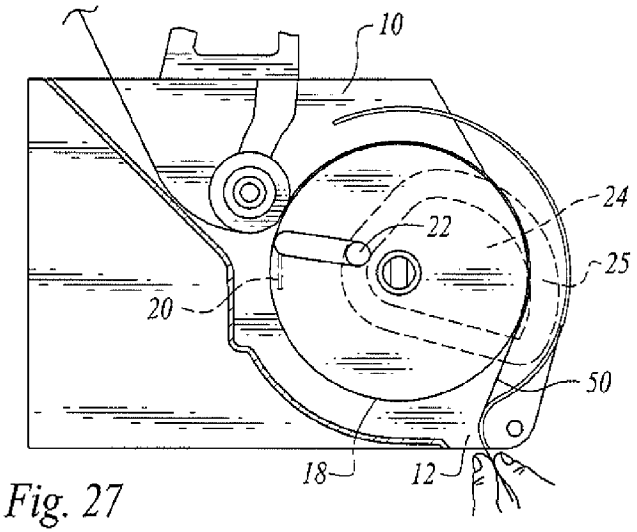
FIG. 27 is a diagrammatic presentation illustrating the condition of structural elements of the apparatus at the point of operation in the hybrid mode where a user has grasped the tail of toweling and initiates pulling.

FIG. 8 shows mechanical electric switch 32 being utilized in this mode of operation as indicated above. FIGS. 9 and 27 show a user manually grasping the tail of the toweling and pulling it to initiate rotation of the toweling support roller 18. Further pulling of the toweling energizes the electric motor to power rotation of the toweling support roller when the switch 32 is closed.

Figure 10:
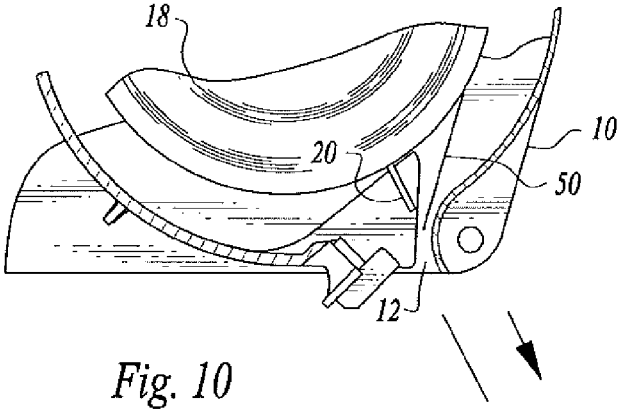
FIG. 10 illustrates the positioning of the toweling after a towel sheet has been removed by the user.

FIG. 10 illustrates a severed toweling section removed from the dispenser and a new tail moving into place to extend to a position under the housing where it can be manually grasped and pulled by the next user. FIGS. 27 through 34 provide an illustration of the operation of the dispenser apparatus, including a dash line illustration in FIGS. 27, 29, 31 and 33 of the location of the blade and follower during consecutive stages in the operation of the apparatus.

Figure 28:
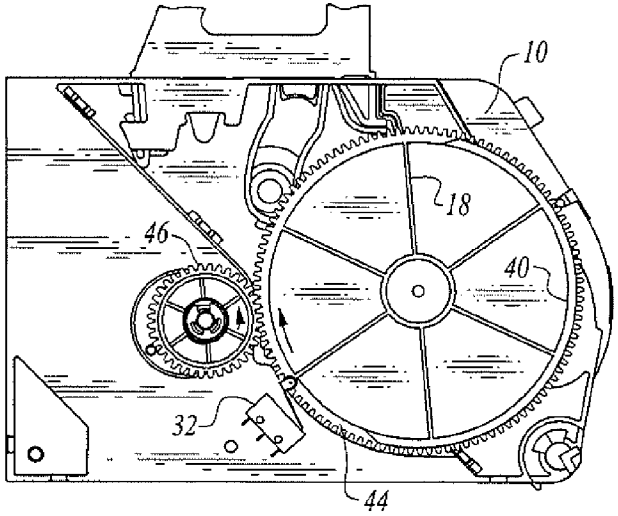
FIG. 28 illustrates the condition of structural components of the invention in the hybrid mode when pulling is initiated by the hand of a user grasping the toweling tail during the stage of operation shown in FIG. 27.
Figure 33:
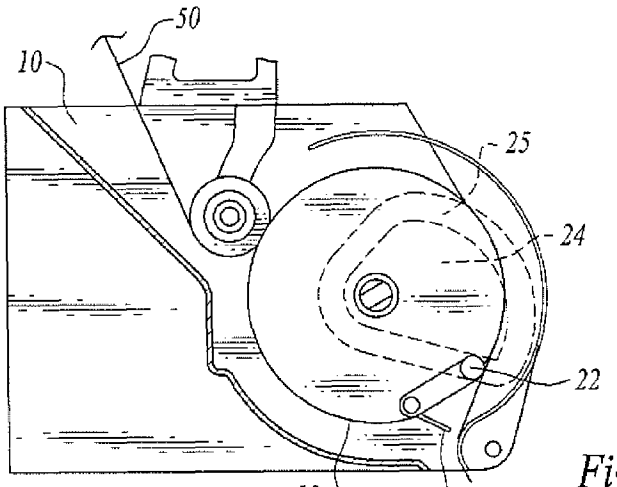
FIG. 33 is a view similar to FIGS. 27, 29 and 31 illustrating the toweling support roller further rotated, the motor de-energized, and a new tail end in the process of being presented to be grasped by a user.
Figure 34:
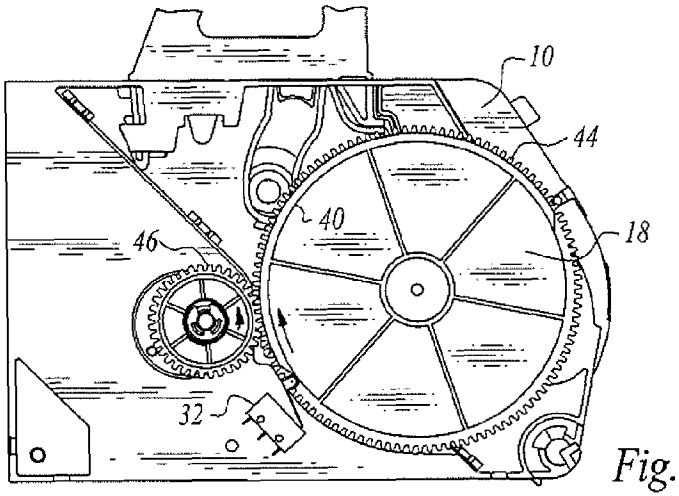
FIG. 34 is a view similar to FIGS. 28, 30 and 32 showing the condition of the structural elements of the apparatus in the stage of operation illustrated in FIG. 33, the electric motor having been de-energized and momentum in the process of returning the toweling support roller to its initial or rest position.

FIGS. 27 and 28 illustrate the condition of the various components when pulling of toweling 50 by a user begins.

The toweling tail may be brought to such position by manually rotating the toweling dispenser roller 18 by a rotatable manually engageable element in the form of a handle or knob 54 connected to the toweling support roller. A one-way clutch (not shown) may be employed to ensure that the toweling support roller is being rotated in a direction to advance toweling. The handle 54 can also be used to advance and dispense the toweling if the batteries fail. The user can pull on the tail as usual when not utilizing the apparatus without motor assistance. In this situation, the required pull force is still relatively low since the gear motor is in effect disengaged from the toweling support roller by employing a one-way clutch needle bearing or some other one-way clutch mechanism.

Figure 29:
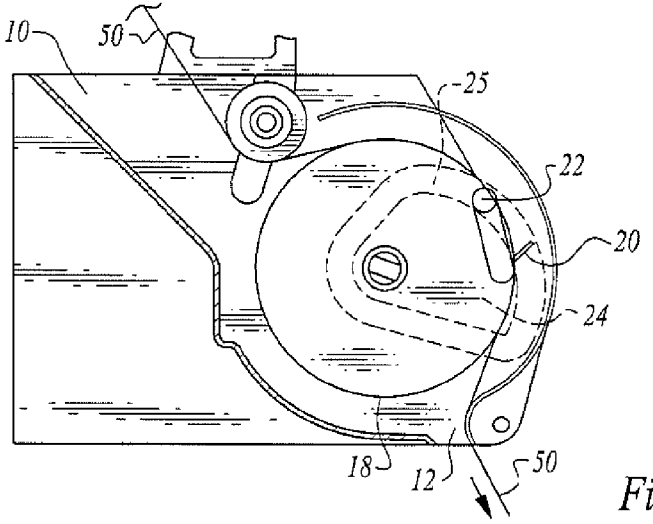
FIG. 29 is a view similar to FIG. 27, but illustrating a stage of operation of the apparatus during the hybrid mode wherein a cutter blade is in severing position and the electric motor is energized to reduce the pulling forces required by the user.
Figure 30:
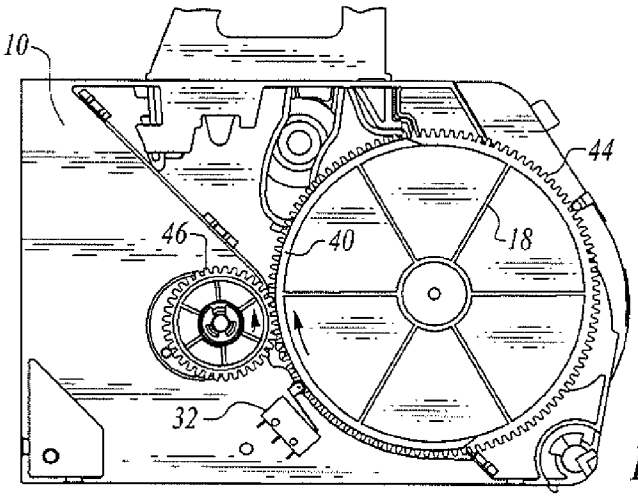
FIG. 30 is a view similar to FIG. 28, but illustrating the condition of structural components in the stage of operation of FIG. 29.

Continued pulling of the toweling tail eventually results in the condition illustrated in FIGS. 29 and 30. The switch 32 is closed since the switch actuator element 34 engages projection 40. Thus, the motor is energized and drives the toweling support roller gear and drive gear as shown by the arrows in FIG. 30. This results in significant reduction in the pulling force that would otherwise be required by the user pulling the toweling tail, greatly reducing the problem of tabbing.

Figure 31:
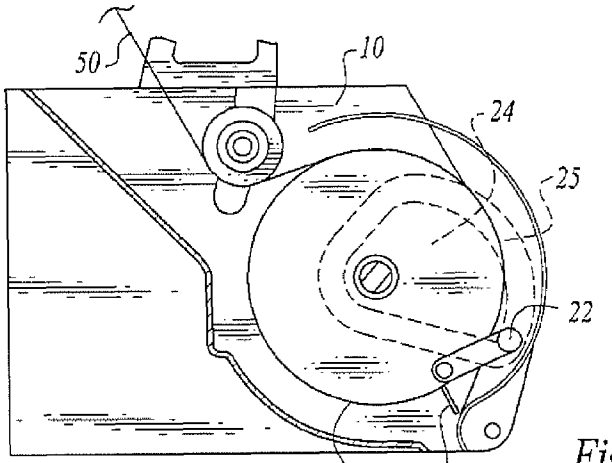
FIG. 31 is a view similar to FIGS. 27 and 29, but showing the endmost sheet of toweling having been severed by the blade and the electric motor still operating to rotate the toweling support roller.
Figure 32:
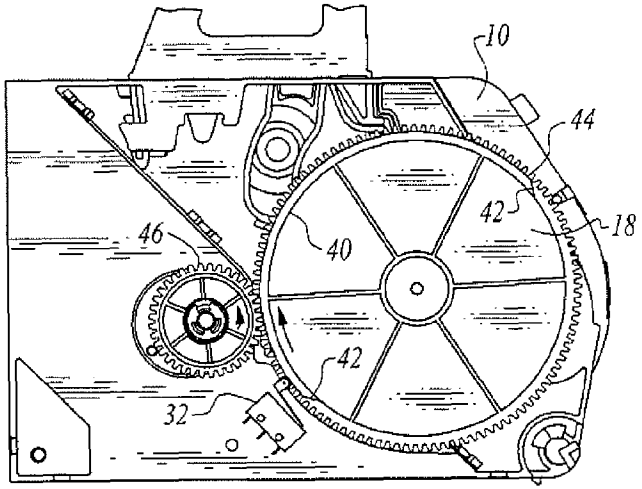
FIG. 32 is a view similar to FIGS. 28 and 30 showing the condition of the structural elements of the apparatus in the stage of operation of FIG. 31.
Figure 35:
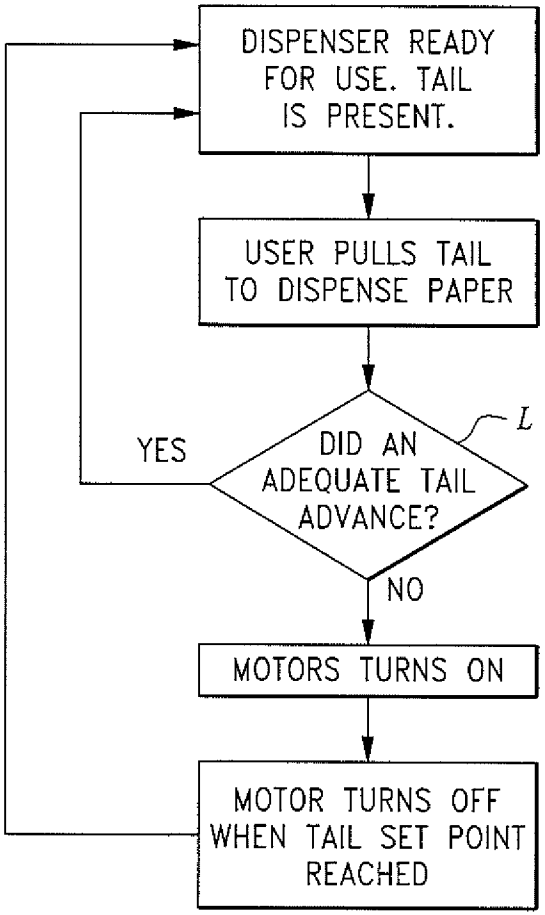
FIG. 35 is a flow chart illustrating operation of a first alternative embodiment of the invention.
Figure 35:
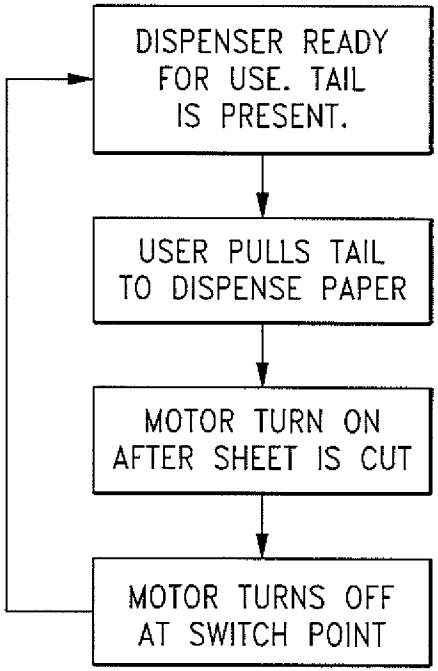
Figure 38:
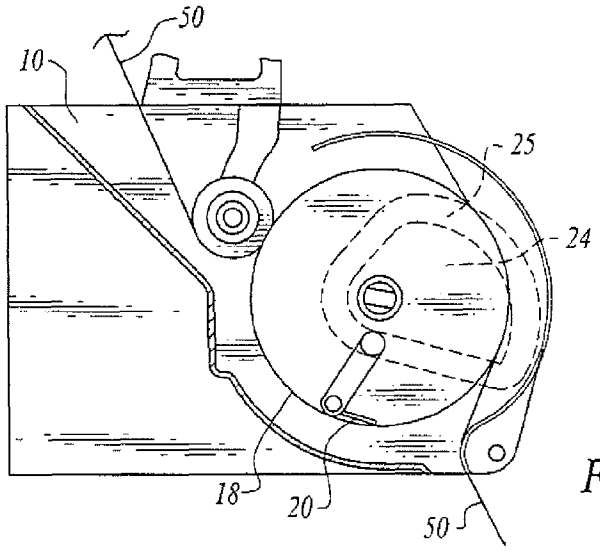
FIGS. 36-39 are views similar to FIGS. 31-34, but illustrating the condition of structural components of the first alternative embodiment in sequential stages of operation.
Figure 39:
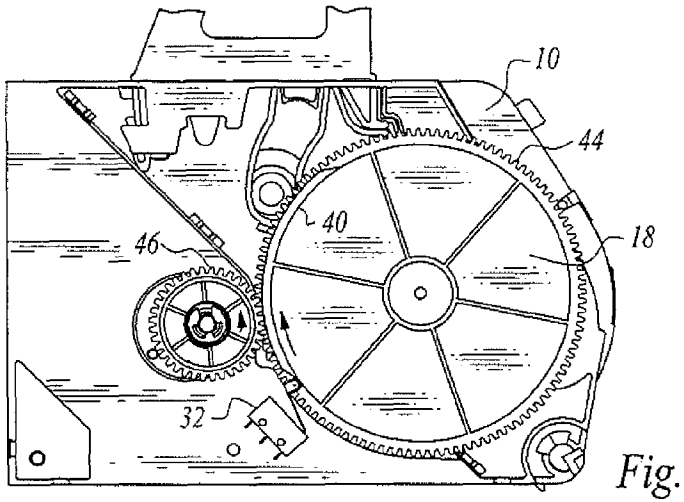
Figure 36:
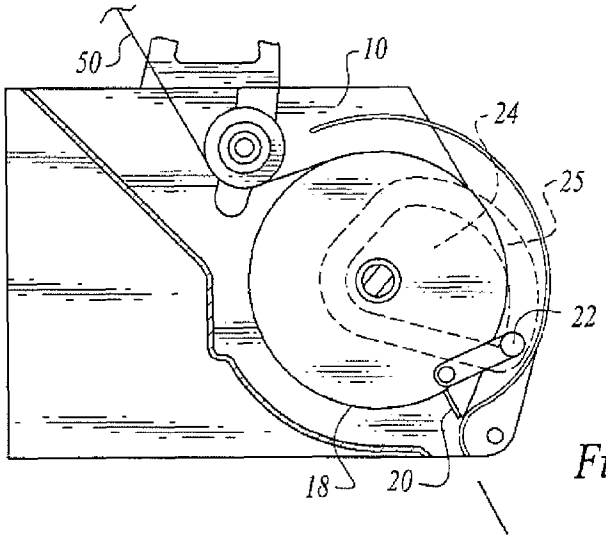
Figure 37:
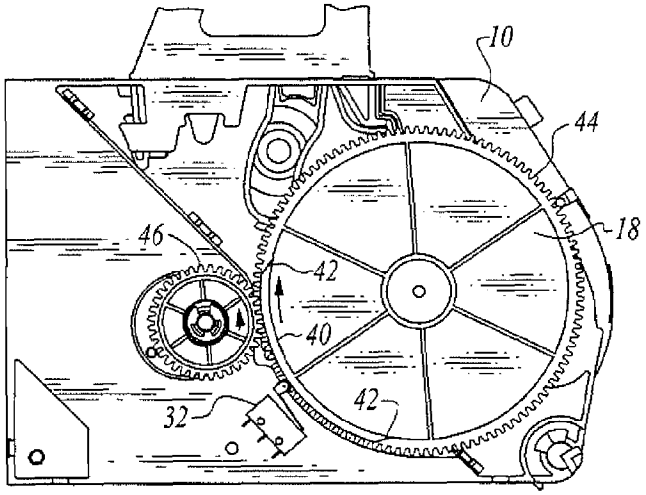

FIGS. 31 and 32 show the condition of the structural components when an individual towel has been severed from the toweling and a new tail end is in the process of being presented to the user. In the arrangement illustrated, and as disclosed in U.S. Pat. Nos. 6,314,850 and 6,553,879, severing is accomplished by the user pulling on the tail when the blade is at the angled position represented in FIG. 29. As indicated in FIG. 32, after severing, the motor will continue to rotate the toweling support roller to advance the next tail. This continues until the structural elements reach the condition shown in FIGS. 33 and 34 wherein the switch is opened to de-energize the electric motor during or after passage of the rearmost tapered end of the projection 40 past the switch.

The tapered projection ends 42 facilitate engagement with the arcuate projection and disengagement therefrom. After de-energization, the momentum of the toweling support roller will bring it back to its initial inactive or rest position until the newly presented tail is pulled to again begin dispensing. The one-way clutch employed in the drive gear 46 results in the de-energized electric motor not impeding this final movement of the toweling support roller.

By changing the configuration of the projection 40, the lengths of the tails projecting from the dispenser can be changed. Also, actual total sheet length can be changed by employing toweling support rollers of different drum diameters.

FIGS. 35-39 relate to an alternative embodiment of the invention. In this embodiment of the invention, a tail is present and projecting from the dispenser which is grasped by the user to begin dispensing, as was the case with the previously described embodiment. However, in this embodiment the electric motor is not energized until a sheet is substantially or completely severed by the cutter blade. After severing of the sheet, the switch 42 is closed and the tail of the remainder of the paper toweling extends through an opening in the housing of the paper towel dispenser apparatus and extends downward therefrom for grasping by the next user.

The FIGS. 36-39 conform to the FIGS. 31-34 relating to the first embodiment and the structural components are the same except for one difference. In the FIGS. 36-39 embodiment the projection 40 has been substantially shortened so that it is engaged with the switch to close the switch for a shorter duration. The switch is not closed before the cutter blade is extended outwardly to its severing position. The duration of the switch in closed condition is sufficient to complete rotation of the rotatable toweling support roller to the position shown in FIG. 33 wherein the new tail projects through the housing opening and extends outwardly from the housing a desired predetermined distance. The life of a battery electrical source employed with the dispenser will be sufficiently prolonged utilizing this approach. Of course disengagement between the switch and the projection at this stage will immediately result in termination of rotation of the toweling support roller.

FIG. 40 is a flow chart which illustrates the operation of a second alternative embodiment which is a more advanced version of the first alternative embodiment. In this more advanced version a logic control L functions as a motor control structure operatively associated with the electric motor and the electric switch for preventing energization of the electric motor to rotate the toweling support roller if the momentum of the toweling support roller caused by a user's pull has been sufficient to place a new tail so that a predetermined adequate length thereof extends outwardly from the housing.

Logic is used to determine if an adequate tail is present. This can be done by incorporating a switch or a sensor in the motor control structure. If an adequate tail is present, the motor does not turn on. If an adequate tail isn't present, the motor will turn on until the drum rotates to a switch point that turns off the motor. In addition to prolonging battery life, a consistent tail length is produced and there is less tabbing than when return springs are utilized for this purpose. Drum return springs add to the amount of pull force required to dispense a sheet of toweling.

Sometimes, in practice, users tear a sheet by pulling sideways instead of downward, in which case the toweling support roller may only rotate slightly, if at all. Logic by means of a sensor can detect if paper is present at the paper exit, and energize the motor to rotate one complete cycle, in effect resetting the dispenser for the next user.

The multi-function paper towel dispenser incorporates sensor structure operatively associated with the electric motor to energize the electric motor and cause rotation of the toweling support roller to transport the paper toweling for dispensing. This sensor structure is utilized in conjunction with electronic control circuitry in a manner which will now be described. When the dispenser is in its hybrid or third mode of operation described above, the sensor structure and electronic control circuitry are not utilized.

The sensor structure is identified by reference numeral 60 and employs a "bouncing" technology in the infrared spectrum that bounces a wave off a hand or paper to activate the unit. That is, the sensor structure is operatively associated with the electric motor to energize the electric motor and cause rotation of the toweling support roller to transport the paper toweling for dispensing from the multi-function paper toweling dispenser in either a first mode of operation wherein the electric motor is energized responsive to the sensor structure sensing positioning of a user's hand or other object at a predetermined location external of the housing or in a second mode of operation wherein the electric motor is energized responsive to the sensor structure sensing the removal of a toweling tail from a location external of the housing.

FIGS. 20A-20D disclose the schematic of electronic control circuitry which may be utilized to carry out the desired electronic functions. It is important to note that the control circuitry utilizes no programmable logic electronics as compared to prior art devices which require programmable logic to operate because they do not have fixed parameters. Because the present invention operates with fixed parameters, mechanical switches can be utilized rather than electronic switches that are controlled by a logic controller/programmable chip. In other words, the present invention employs discrete digital logic in the electronic circuitry instead of programmable logic. Simple resistors and capacitors are utilized instead, these being located on a circuit board 62 electrically connected between the sensor 60 and the electric motor 30.

The control switch panel 64 and control switches shown in FIGS. 6, 11, 16, and 18 are associated with the electronic circuit board and utilized to select the various modes in which the multi-function paper towel dispenser can operate. Switch 66 is employed to switch between the hybrid mode of operation described above and an electronic mode of operation wherein the sensor structure 60 and control circuitry are utilized to operate the dispenser in either a paper hidden mode (hereinafter sometimes referred to as the first mode) of operation or a paper exposed mode (sometimes hereinafter referred to as the second mode of operation). Switch 68 of the switch display selects either the paper hidden mode or the paper exposed mode. A third switch 70 is utilized to set and adjust the time delay between cycles, for example approximately one second or approximately three seconds. When the switch 66 is set to hybrid operation, the switches 68 and 70 for exposed paper or hidden paper operation and time delay adjustment are inactive.

Figure 11:
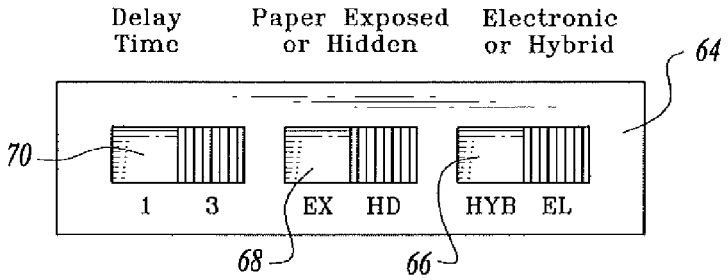
FIG. 11 is a view similar to FIG. 6, but illustrating the condition of the control switches during a different mode of operation.
Figure 13:
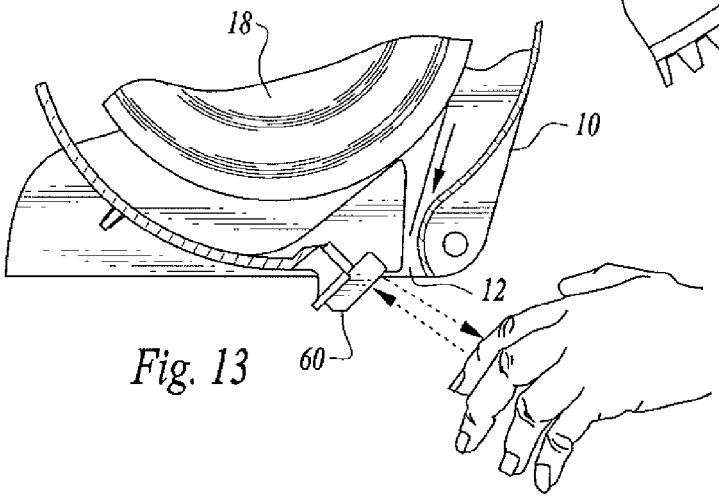
FIG. 13 is a view similar to FIG. 9, but illustrating initial dispensing of a towel in response to a sensed user's hand.
Figure 15:
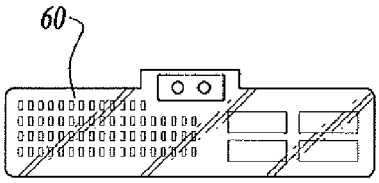
FIG. 15 is a plan view illustrating sensor structure of the multi-function paper towel dispenser.

FIG. 11 illustrates switch 66 set for electronic control and switch 68 set for the paper hidden or first mode of operation wherein the electric motor is energized responsive to the sensor structure sensing positioning of a user's hand at a predetermined location external of the housing. FIG. 13 illustrates a user's hand positioned where it can be sensed and the infrared wave transmitted by sensor structure 60 being bounced off the hand to the sensor structure receiver. This results in the control circuitry on circuit board 62 energizing the electric motor and causing rotation of the toweling support roller to move the towel tail in a downward direction as illustrated by the arrow and available for grasping and removal by the user.

A second mechanical electric switch 76 is employed when the multi-function paper towel dispenser operates in either the paper hidden mode or paper exposed mode to stop rotation of the toweling support roller when the dispensing cycle is completed. Switch 76 is fixedly mounted adjacent to toweling support roller gear 44 and is engageable during rotation of the toweling support roller by a projection 78 extending from the gear 44. Once the first and second mode mechanical electrical switch 76 is engaged by the projection 78, rotation of the toweling support roller and transport of the toweling will be halted.

During rotation of the toweling support roller the blade associated with the toweling support roller will cut the sheet, the amount of which is controlled by the position of the actuator of mechanical electric switch 76. In a preferred actuator position, the sheet is cut more than ninety percent. This allows the user to easily remove the sheet with a very light pull force. When the sheet is removed by the user, the dispenser will not dispense another sheet until the user puts a hand under the sensor.

Figure 12:
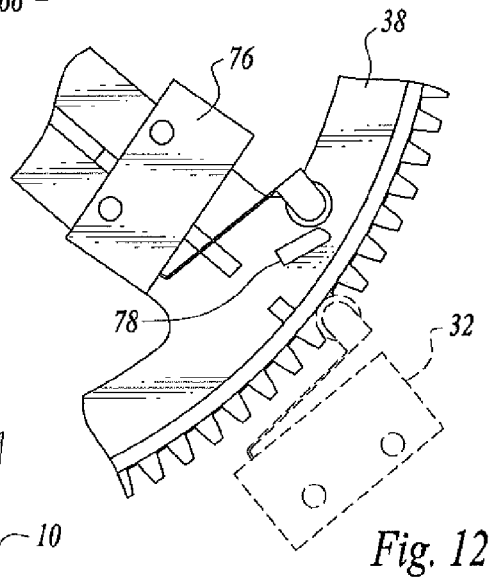
FIG. 12 is a view similar to FIG. 8, but illustrating the condition of the toweling support roller and the mechanical electric switches associated therewith in a different mode of operation as determined by the control switches in FIG. 11 wherein the electric motor is energized responsive to sensor structure sensing positioning of a user's hand.
Figure 14:
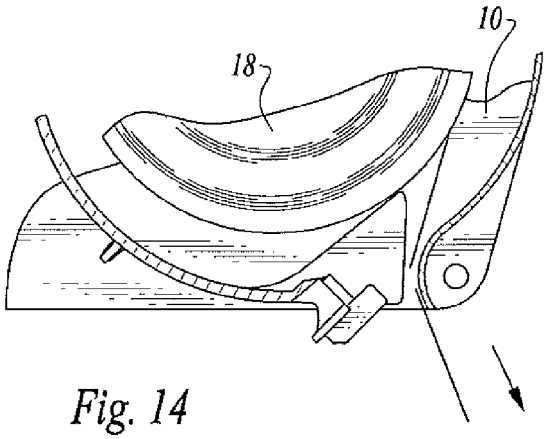
FIG. 14 illustrates a towel removed from the rest of the toweling at the end of the dispensing cycle illustrated.
Figure 20A:
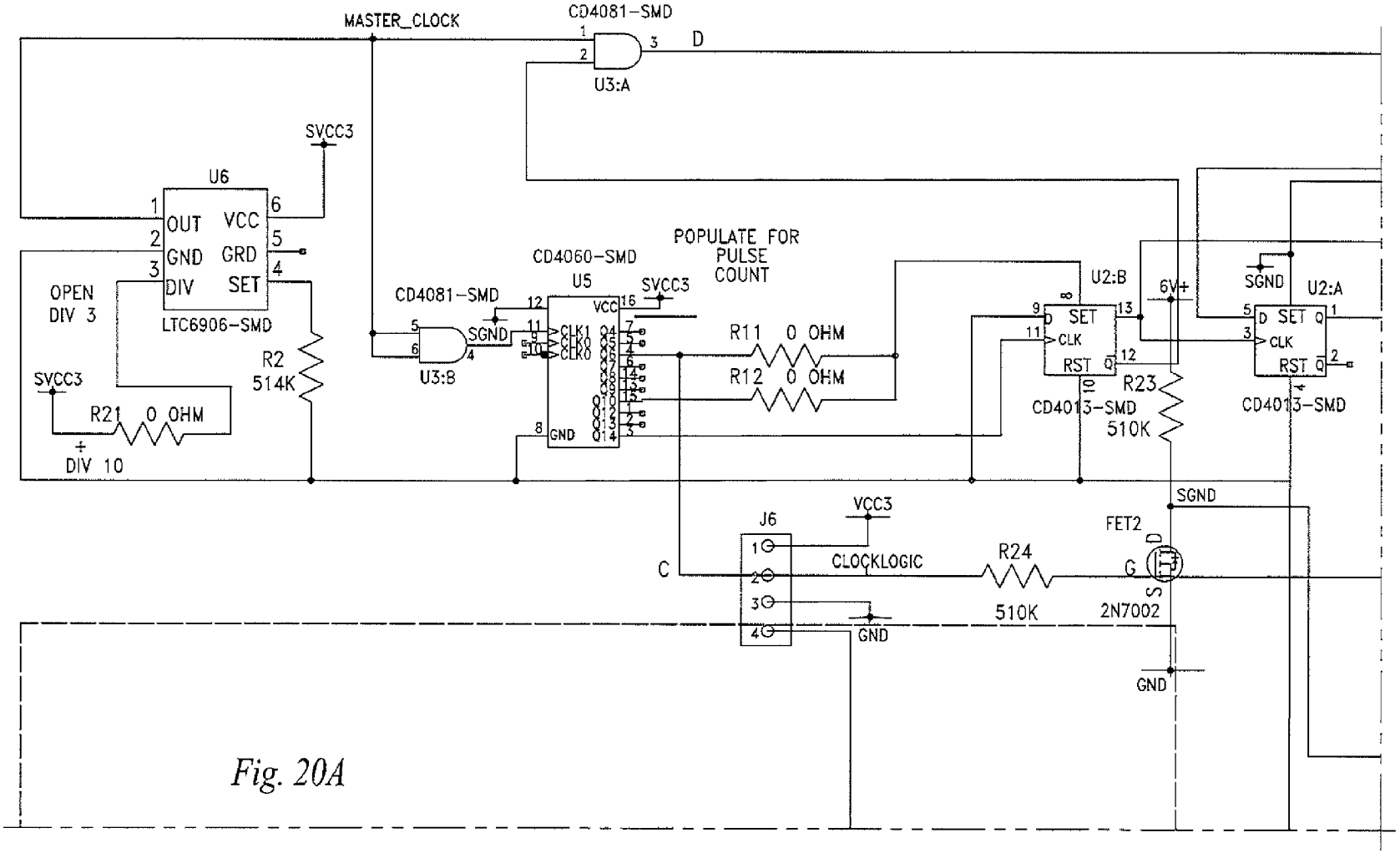
FIGS. 20A-20D illustrate these segments.
Figure 20B:
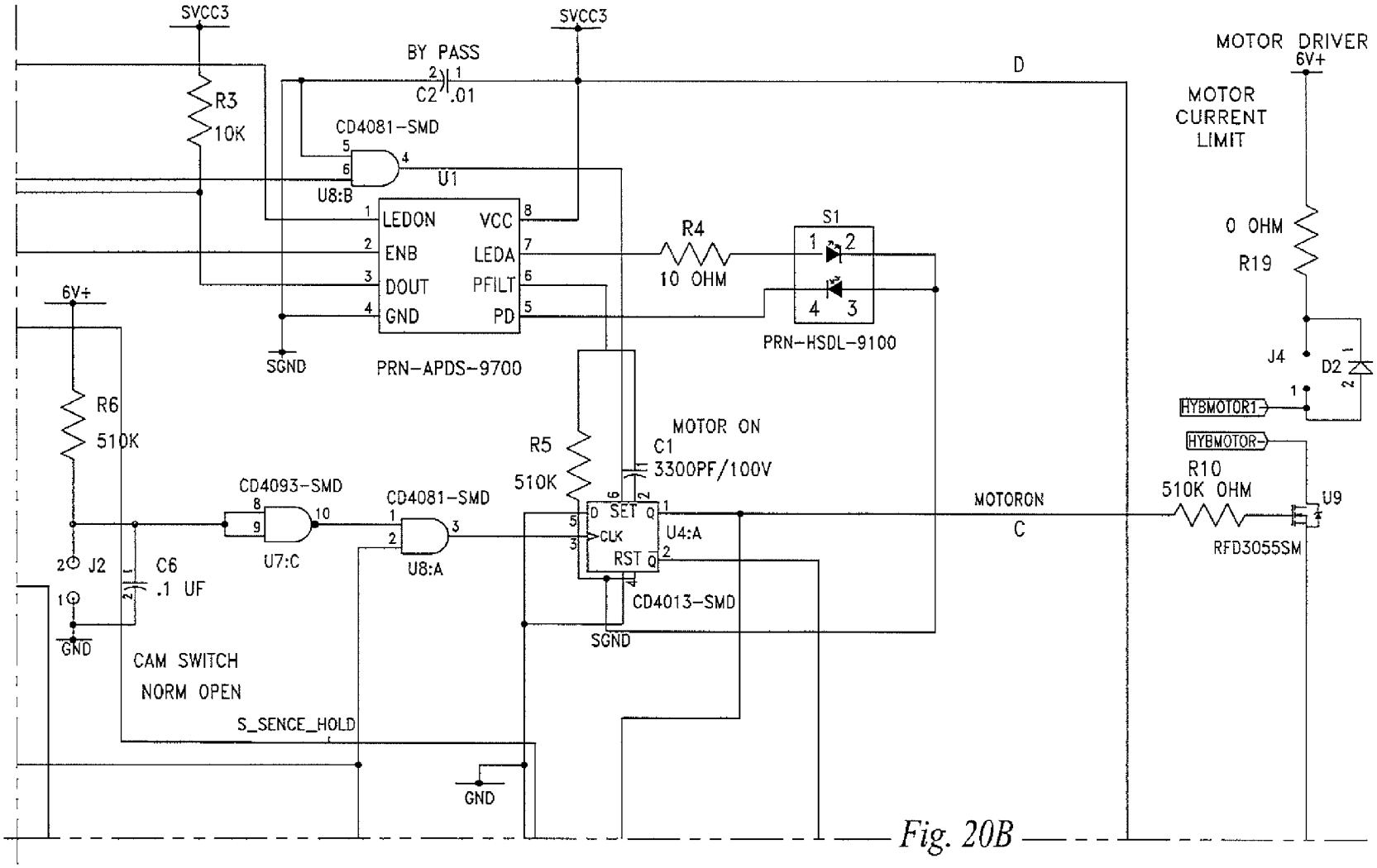
Figure 20C:
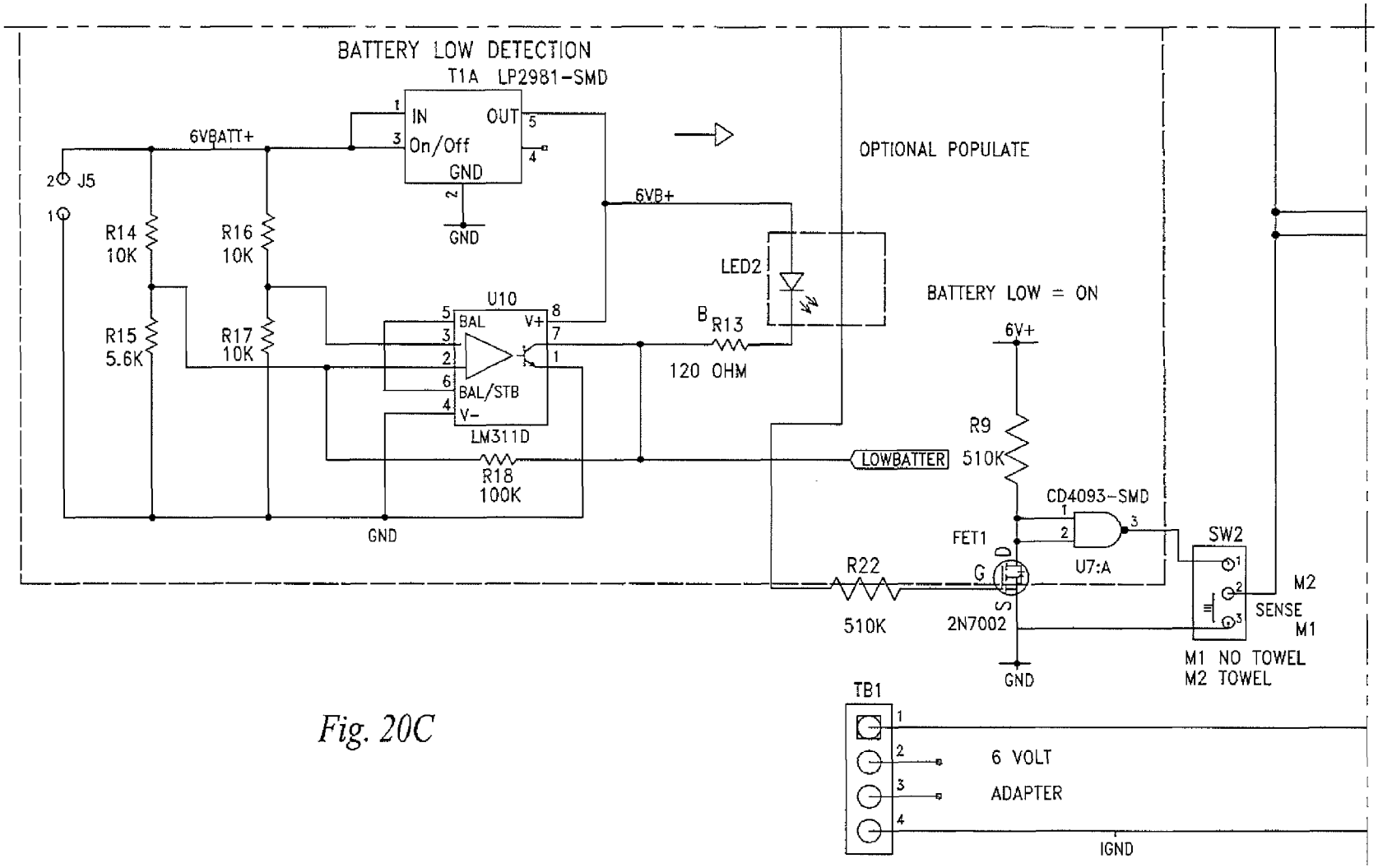
Figure 20D:
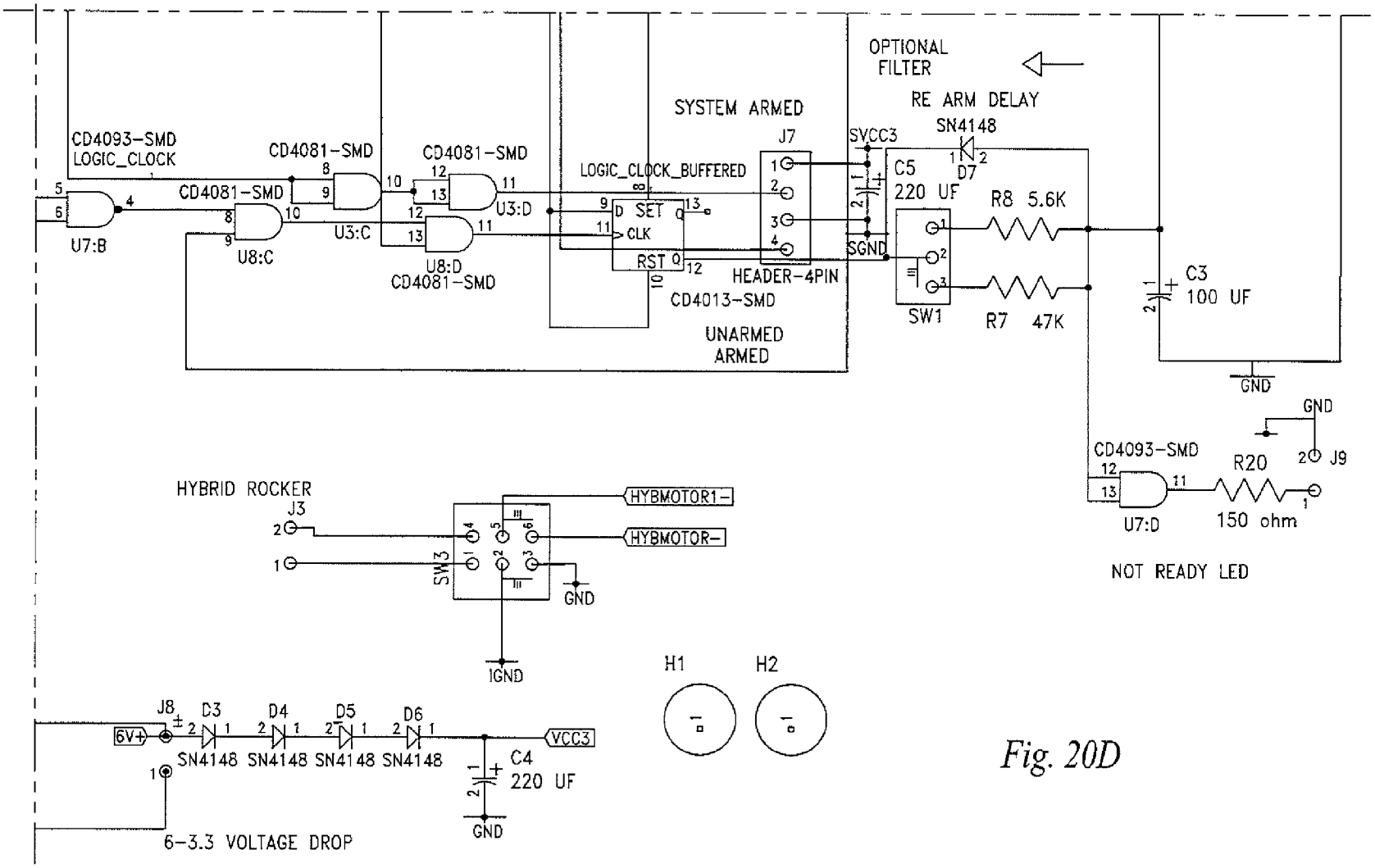
Figure 21:
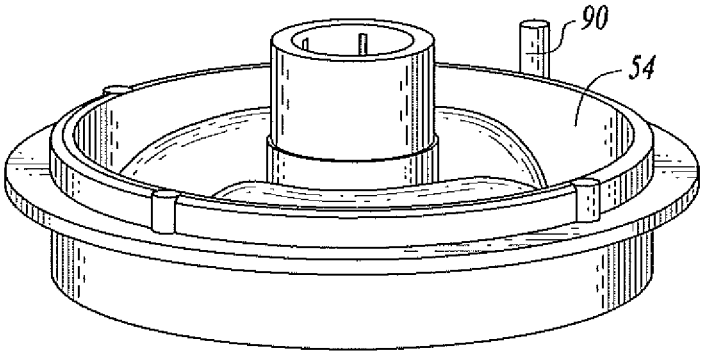
FIG. 21 is a perspective view of a manually graspable turning knob or handle employed to rotate the toweling support roller having a projection in the form of a post extending outwardly therefrom.

FIGS. 11, 12 and 14 illustrate operation in the first or paper hidden mode.

Figure 2:
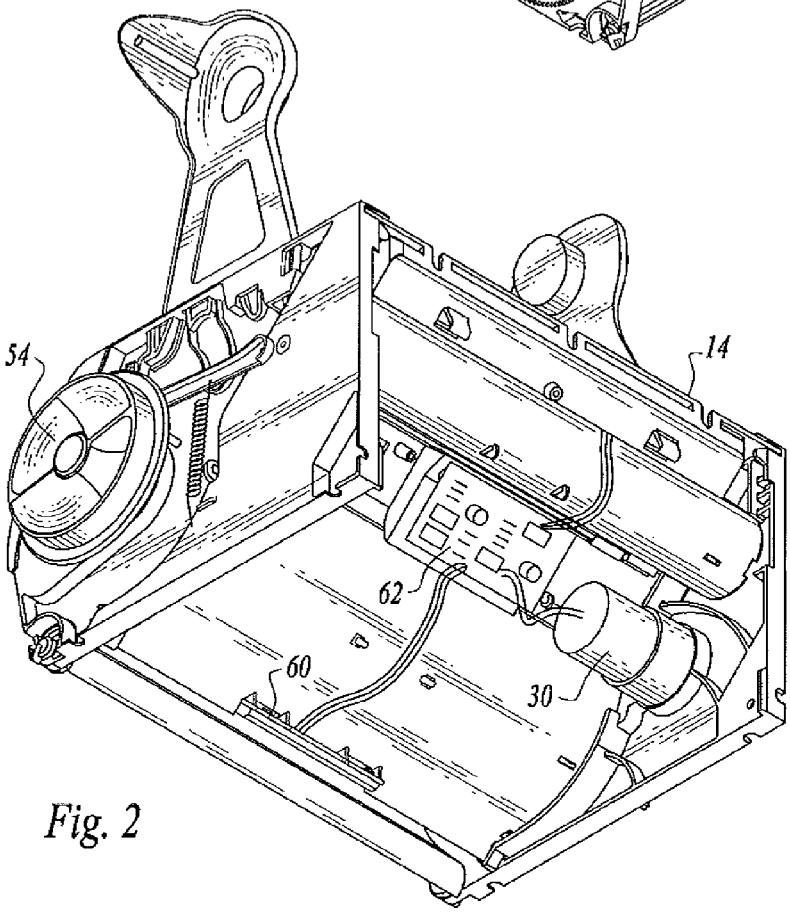
FIG. 2 is a back, perspective view of the components.
Figure 4:
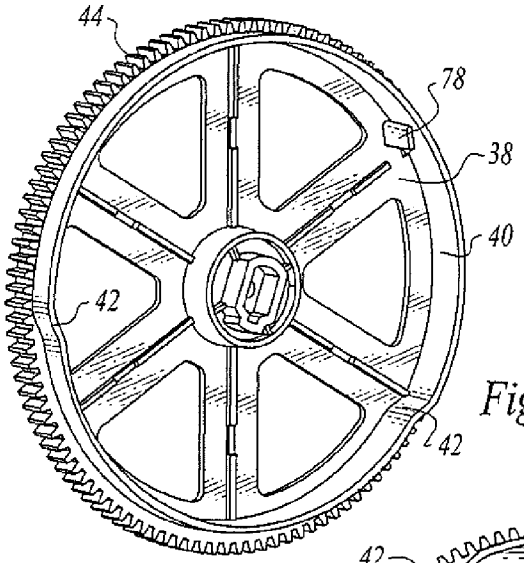
FIG. 4 is a perspective view illustrating a drive gear of the toweling support roller.
Figure 5:
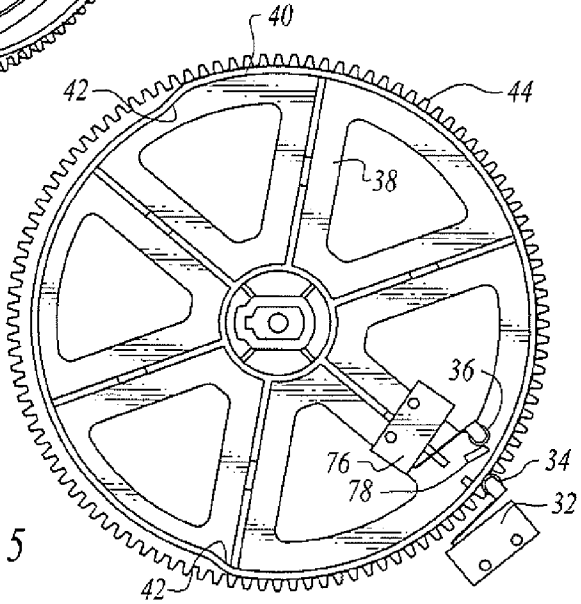
FIG. 5 is a side elevational view of the drive gear of the toweling support roller and illustrating mechanical electric switches employed therewith.
Figure 3:
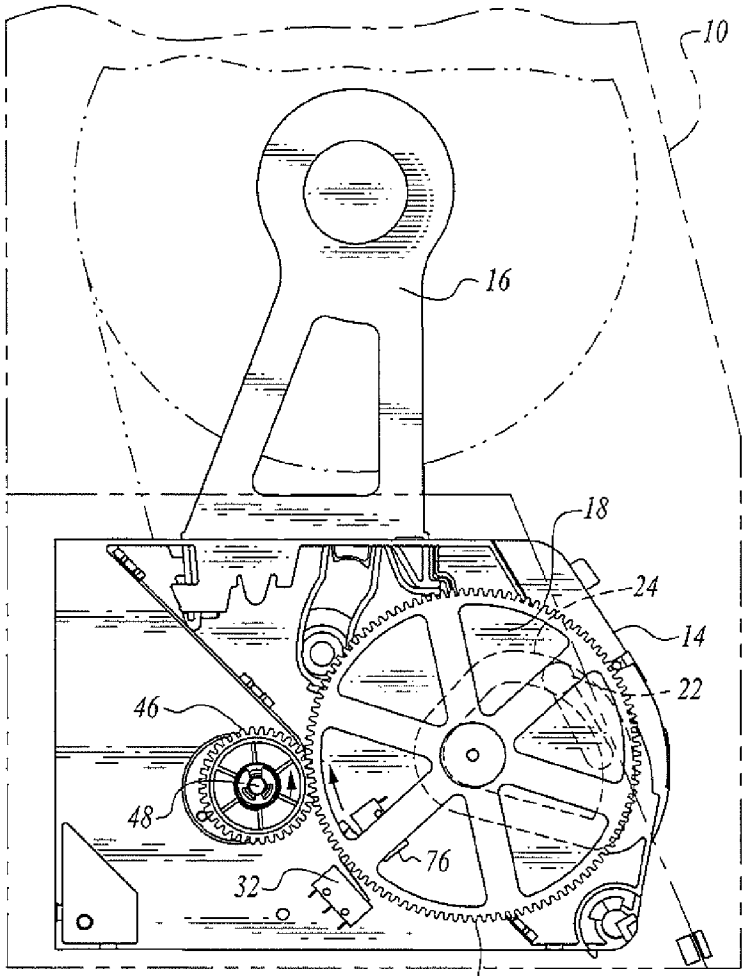
FIG. 3 is a side, elevational view showing the structure illustrated in FIG. 3 in solid lines, a housing and a supply roll of toweling being shown in phantom lines.

FIG. 16 shows the control switch panel with the control switches 66 and 68 in the same positions as shown in FIG. 11, but with switch 70 changed to a position which sets the delay time between cycles to approximately one second as compared to three seconds in FIG. 1.

FIG. 17 is a view similar to FIG. 13, but with the paper towel dispenser inactive and with the tail in a hidden position, that is in a position where the tail is essentially non-visible from outside the housing. Again, reactuation will only take place if a hand or other object is in a position relative to the housing and sensor 60 that would initiate the next cycle, which can occur after approximately a second has passed.

FIG. 18 shows the switch 66 in the electronic control position and switch 68 selecting the paper exposed or second mode of operation wherein the electric motor is energized responsive to the sensor sensing the removal of a toweling tail from a location external of the housing. In this mode the sensor is looking for the presence of a paper tail. As long as the paper tail is covering the sensor's range, the motor remains deenergized. When a user removes the hanging sheet, the lack of paper in front of the sensor will trigger the motor to turn on. The motor turns the toweling support roller until mechanical electric switch 76 is triggered by the projection 78 on the toweling support roller gear 44. Rotation of the toweling support roller will have advanced and cut the sheet, the amount of which is controlled by the switch actuator position of mechanical electric switch 76. In this mode of operation, the multi-function paper towel dispenser always has a long tail of paper hanging downwardly from the housing, for example 9 inches. In a preferred embodiment, the sheet is pre-cut more than ninety percent. This allows the user to easily remove the sheet with a very light pull force.

The arrangement described above incorporates battery saving features. By not using a controller chip the circuit board uses less electricity than would otherwise be the case. Furthermore, the sensor is not continuously on but rather is pulsed by the control circuitry, for example about five times per second. In the long run, a dispenser that sees light usage (with respect to sheets dispensed) may have a considerable percentage of its batteries drained by the circuit board. Having a board that uses less energy can extend battery life most noticeably in dispensers that are subject to low use conditions.

It has been found that while dispensing from hidden paper (first) or exposed paper (second) modes the sensor structure can be covered by a small towel tail leaving the dispenser in a less than desirable condition. This can happen for a number of reasons, including a user pulling on the exposed sheet before the motor has turned off. When this happens in the hidden mode the dispenser will not dispense a sheet even when the user puts his or her hand next to the sensor. The feed knob 54 will need to be turned to advance the sheet.

When this condition exists in the paper exposed mode, the next sheet will not automatically advance, the feed knob having to be used to advance the sheet.

FIGS. 21-26 disclose operation of structure for resolving these potential problems. In particular, stop structure is provided for operative association with the toweling support roller to temporarily stop rotation of the toweling support roller during operation of the dispenser.

The stop structure includes a pivoted stop arm 84 pivoted about pivot point 86 and biased in a downward direction as viewed in these figures by a spring 88. Knob 54, which is rotatable with the toweling support roller, has a member in the form of post 90 projecting therefrom in an inward direction. When the toweling support roller is being rotated by the electric motor 30, the knob and post 90 will also rotate as shown in FIGS. 22-25 and the post engages portions of the arm.

Figure 22:
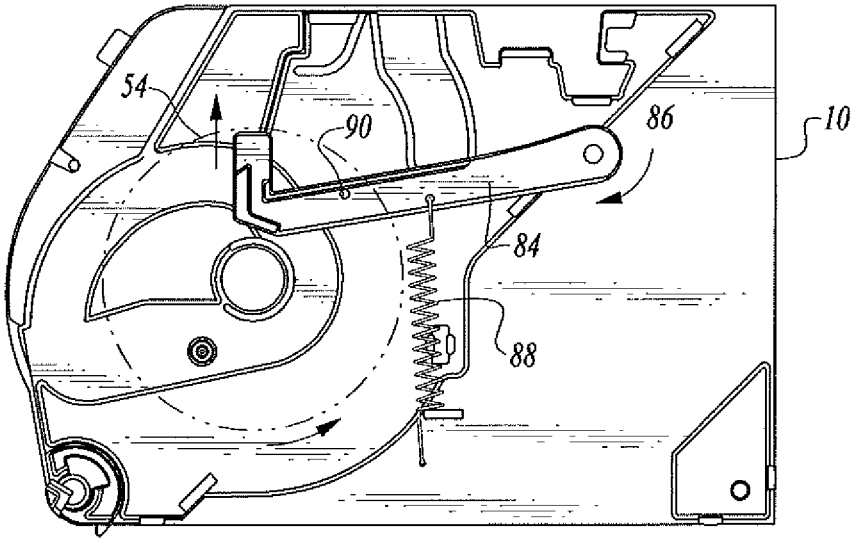
FIGS. 22-26 are views illustrating the knob and post rotated to different positions, the post moving a spring biased pivoted stop art to different positions, the pivoted stop arm being used to temporarily stop rotation of the toweling support roller during operation of the dispenser.
Figure 23:
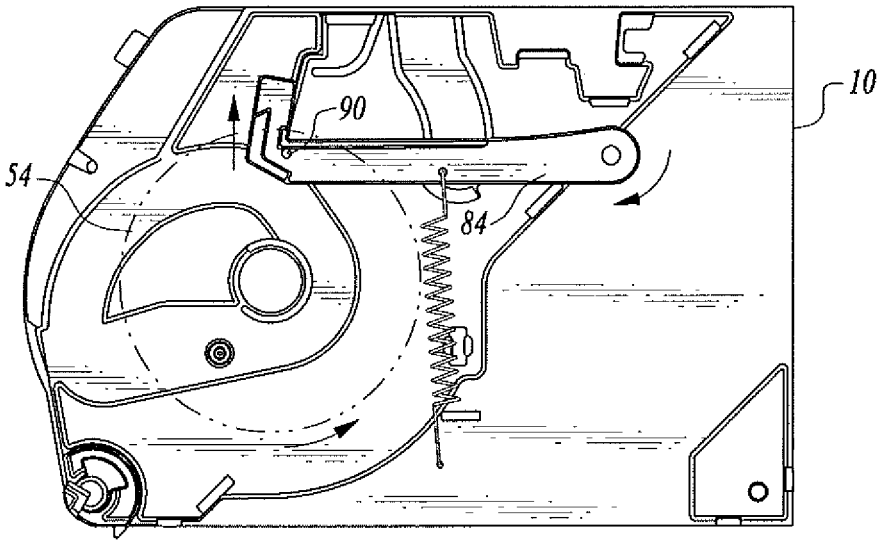
Figure 24:
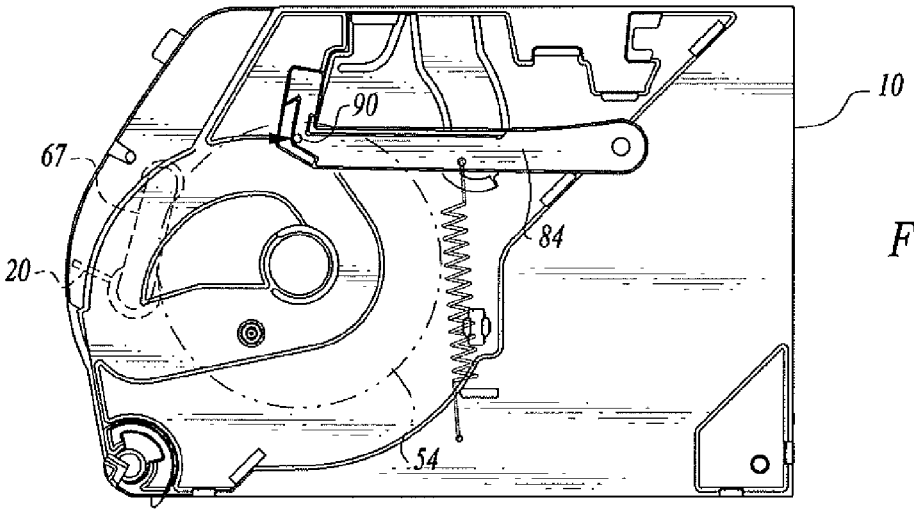

FIGS. 22 and 23 show the knob rotating and the post 90 engaging the underside of a top portion of the pivoted stop arm causing the stop arm to pivot and lift upwardly. When the knob post reaches the position shown in FIG. 24, momentary engagement between the post and arm briefly stops rotation of the toweling support roller, the knob post 90 being in lock up position. FIG. 24 shows the tear blade position and orientation by phantom lines at the point where the toweling support roller rotation is stopped by the arm and post.

Figure 25:
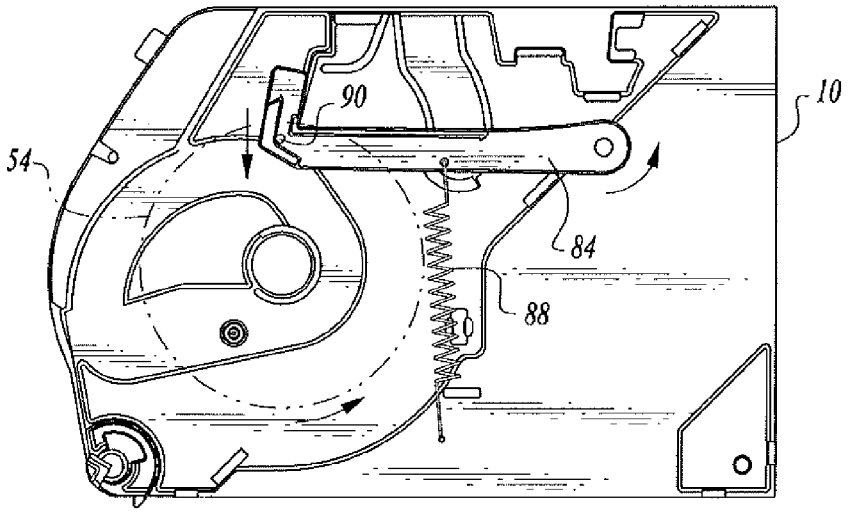
Figure 26:
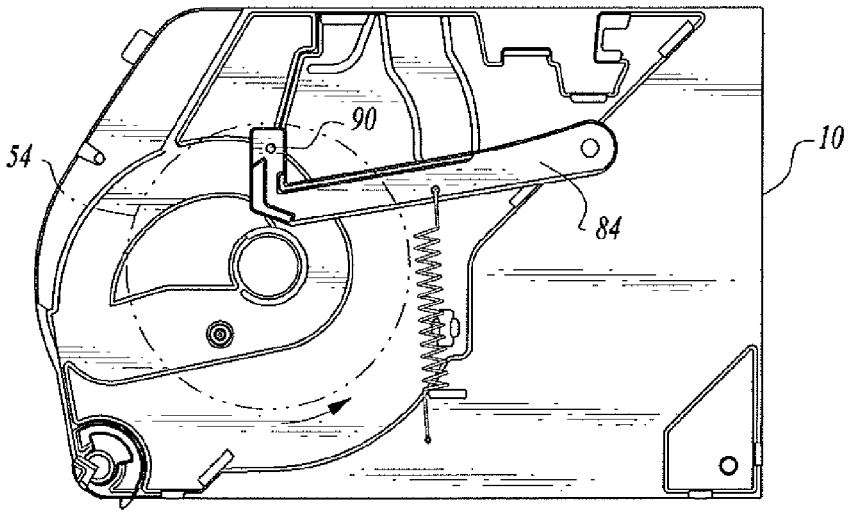

After the toweling support roller has stopped, the arm drops out of the way as shown in FIG. 25. FIG. 26 shows return of the pivoted stop arm to its lower (unlocking) position and the post positioned to exit the pivoted stop arm during continued rotation of the toweling support roller and post 90. The toweling support roller is now free to be rotated by the motor, a user pulling on the exposed sheet or a user rotating the knob.

The pivoted stop arm has the same stop position for either the first or second (paper hidden or paper exposed) modes of operation. However, the stop would have to be in a different position to be used with the hybrid or third operation mode. If the pivoted stop arm is installed in the multi-function paper towel dispenser, only the exposed and hidden modes would work. In that case, the dispenser likely would be made available without the hybrid or third mode operational feature. However, the stop arm could be a desirable feature for a stand alone hybrid system as taught by co-pending U.S. patent application Ser. No. 13/466,334, as well. For example, if a user pulls the sheet too hard, the momentum of the toweling support roller might be sufficient to advance an extra sheet which some customers do not like. The arm would stop toweling support roller rotation before the electric switch 32 associated with hybrid operation is actuated.

The invention claimed is:

1. A multi-function paper sheet material dispenser selectively operable to dispense paper toweling or other paper sheet material from a roll employing a plurality of alternative operational modes, said paper sheet material dispenser comprising, in combination:

a housing;

a roll support within said housing for supporting a roll of paper sheet material;

a rotatable paper sheet material support roller within said housing for receiving paper sheet material from a roll of paper sheet material;

an electric motor operatively associated with said paper sheet material support roller for selectively rotating said paper sheet material support roller;

sensor structure operatively associated with said electric motor to energize said electric motor and cause rotation of said paper sheet material support roller to transport the paper sheet material for dispensing from said multi-function paper sheet material dispenser in either a first mode of operation wherein said electric motor is energized responsive to said sensor structure sensing positioning of a user's hand or other object at a predetermined location external of said housing or in a second mode of operation wherein said electric motor is energized responsive to said sensor structure sensing the removal of a paper sheet material tail from a location external of said housing;

an electric switch operatively associated with said electric motor and with said paper sheet material support roller, said electric switch responsive to rotation of said paper sheet material support roller in a third mode of operation caused by a user of the paper sheet material dispenser pulling on the paper sheet material tail projecting through said opening and extending outwardly from said housing to a first position to energize said electric motor when the paper sheet material support roller reaches said first position and cause rotation of said paper sheet material support roller by said electric motor from said first position to a second position; and a cutter blade for substantially or completely severing the paper sheet material on said paper sheet material support roller during rotation thereof in said third mode of operation caused solely by the user pulling on the paper sheet material tail and without energization and use of said electric motor before said paper sheet material support roller reaches said first position, and said electric switch responsive to rotation of said paper sheet material support roller by said energized electric motor to said second position to de-energize said electric motor and present a new tail projecting through said opening and extending outwardly from said housing.

2. The multi-function paper sheet material dispenser according to claim 1 including a mode selection switch enabling a user to alternatively select said first, second or third modes of operation.

3. The multi-function paper sheet material dispenser according to claim 2 additionally including electronic control circuitry operatively associated with said electric motor and said sensor structure for selectively alternatively initiating operation of said multi-function paper sheet material dispenser in either said first mode of operation or said second mode of operation.

4. The multi-function paper sheet material dispenser according to claim 3 wherein said electronic control circuitry is non-programmable and includes a first and second mode mechanical electrical switch operatively associated with said electric motor responsive to rotation of said paper sheet material support roller during either said first or second modes of operation to de-energize said electric motor and stop rotation of said toweling support roller.

5. The multi-function paper sheet material dispenser according to claim 4 wherein said first and second mode mechanical electrical switch includes a switch actuator element engageable by said paper sheet material support roller.

6. The multi-function paper sheet material dispenser according to claim 5 wherein said paper sheet material support roller includes a projection, the switch actuator element of said first and second mode mechanical electrical switch alternatively being engaged with said projection or disengaged from said projection during rotation of said paper sheet material support roller.

7. The multi-function paper sheet material dispenser according to claim 5 wherein the switch actuator element of said first and second mode mechanical electrical switch is positioned at a predetermined location relative to said paper sheet material support roller to produce a paper sheet material tail extending downwardly from the housing visible to and manually graspable by a user and the presence thereof sensed by said sensor structure when said multi-function paper sheet material dispenser is in said second mode of operation, said sensor structure including an infrared transmitter and receiver.

8. The multi-function paper sheet material dispenser according to claim 5 wherein the switch actuator element of said first and second mode mechanical electrical switch is positioned at a predetermined position relative to said paper sheet material support roller to produce a paper sheet material tail essentially non-visible from outside said housing.

9. The multi-function paper sheet material dispenser according to claim 3 wherein said control circuitry includes a time delay control switch and is operable responsive to manual actuation of said time delay control switch to alter the delay time required between dispensing of toweling by said multi-function paper sheet material dispenser when said multi-function paper sheet material dispenser is in either said first mode of operation or said second mode of operation.

10. The multi-function paper sheet material dispenser according to claim 3 wherein said electronic control circuitry is operable employing discrete digital logic and does not incorporate a controller chip.

11. The multi-function paper sheet material dispenser according to claim 1 wherein said cutter blade is pivotally mounted on said paper sheet material support roller and blade actuator structure for moving said cutter blade during rotation of said paper sheet material support roller to sever paper sheet material on said paper sheet material support roller during rotation of said paper sheet material support roller before said sheet material support roller reaches said first position.

12. The multi-function paper sheet material dispenser according to claim 11 wherein said blade actuator structure includes a cam follower attached to said blade and cam structure accommodating said cam follower, said cam follower moving in said cam structure during rotation of said paper sheet material support roller to sever paper sheet material being transported by said paper sheet material support roller when said paper sheet material support roller is rotating to said first position.

13. The multi-function paper sheet material dispenser according to claim 12 wherein said cutter blade is pivotally mounted on said paper sheet material support roller and is movable between an inactive position wherein said cutter blade will not sever said paper sheet material and a severing position wherein a cutting edge of the cutter blade is positioned outwardly of said paper sheet material support roller to sever the paper sheet material on said paper sheet material support roller.

14. The multi-function paper sheet material dispenser according to claim 13 wherein said cutter blade moves toward and is substantially in the severing position prior to energizing said electric motor.

15. The multi-function paper sheet material dispenser according to claim 1 wherein said electric motor is electrically connected to said electric switch with no control circuit board intermediate the electric motor and the electric switch.

16. The multi-function paper sheet material dispenser according to claim 1 additionally comprising a motor control structure operatively associated with said electric motor and said electric switch for preventing energization of said electric motor to rotate the paper sheet material support roller if the momentum of the paper sheet material support roller caused by a user's pull has been sufficient to place the new tail with a predetermined adequate length extending outwardly from said housing.

17. The multi-function paper sheet material dispenser according to claim 16 wherein said motor control structure is operable to energize said electric motor to further rotate said paper sheet material support roller if the momentum of the paper sheet material support roller caused by a user's pull was not sufficient to place the new tail with a predetermined adequate length thereof extending outwardly from the housing.

18. The multi-function paper sheet material dispenser according to claim 1 wherein said electric switch includes a switch actuator element engageable with said paper sheet material support roller to alternatively open or close said electric switch during rotation of said paper sheet material support roller.

19. The multi-function paper sheet material dispenser according to claim 18 wherein said paper sheet material support roller includes a projection, said switch actuator element alternatively being engaged with said projection during rotation of said paper sheet material support roller to alternatively open or close said electrical switch during rotation of said paper sheet material support roller.

20. The multi-function paper sheet material dispenser according to claim 1 additionally comprising stop structure operatively associated with said paper sheet material support roller to temporarily stop rotation of said paper sheet material support roller during operation of said multi-function paper sheet material dispenser.

21. The multi-function paper sheet material dispenser according to claim 20 wherein said stop structure includes a pivoted stop arm within said housing.

22. The multi-function paper sheet material dispenser according to claim 21 wherein said stop structure additionally includes a member projecting from and rotatable with said paper sheet material support roller momentarily engageable with said pivoted stop arm to temporarily stop rotation of said paper sheet material support roller during operation of said multi-function paper sheet material dispenser.

23. The multi-function paper sheet material dispenser according to claim 22 including a spring biasing said pivoted stop arm to a position in which said pivoted stop arm does not stop rotation of said paper sheet material support roller, said projection operable to move said pivoted stop arm against the bias exerted by said spring.

24. The multi-function paper sheet material dispenser according to claim 1 wherein said sensor structure is a pulsed sensor.

25. The multi-function paper sheet material dispenser according to claim 1 additionally comprising a rotatable/manually engageable element connected to said paper sheet material support roller enabling a user to manually rotate said paper sheet material support roller to advance said paper sheet material.

* * * * *